US007695301B2

(12) United States Patent
Mudge, III et al.

(10) Patent No.: US 7,695,301 B2
(45) Date of Patent: Apr. 13, 2010

(54) SUBMERSIBLE CONNECTOR WITH SECONDARY SEALING DEVICE

(75) Inventors: William F. Mudge, III, St. Augustine, FL (US); Stewart M. Barlow, Ormond Beach, FL (US)

(73) Assignee: Teledyne ODI, Inc., Daytona Beach, FL (US)

( * ) Notice: Subject to any disclaimer, the term of this patent is extended or adjusted under 35 U.S.C. 154(b) by 0 days.

(21) Appl. No.: 12/188,082

(22) Filed: Aug. 7, 2008

(65) Prior Publication Data

US 2010/0035452 A1 Feb. 11, 2010

(51) Int. Cl.
*H01R 13/52* (2006.01)

(52) U.S. Cl. ..... 439/271; 439/281; 439/732; 439/587

(58) Field of Classification Search ..... 439/271, 439/281, 732, 587
See application file for complete search history.

(56) References Cited

U.S. PATENT DOCUMENTS 3,787,796 A * 1/1974 Barr ..... 439/281
4,417,736 A * 11/1983 Herrmann, Jr. ..... 439/281
4,909,751 A 3/1990 Marolda, Jr.
4,917,620 A * 4/1990 Samejima et al. ..... 439/271
4,948,377 A 8/1990 Cairns
5,203,805 A 4/1993 Cairns
5,622,512 A * 4/1997 Uchida et al. ..... 439/271
5,645,442 A 7/1997 Cairns
5,899,765 A 5/1999 Niekrasz et al.
6,332,787 B1 12/2001 Barlow et al.
7,402,063 B2 * 7/2008 Montena ..... 439/271
2008/0274636 A1 11/2008 Marklove et al.

FOREIGN PATENT DOCUMENTS

CA 2620273 3/2007

* cited by examiner

*Primary Examiner*—Tho D Ta
(74) *Attorney, Agent, or Firm*—Procopio, Cory, Hargreaves & Savitch LLP

(57) ABSTRACT

A submersible connector has releasably mateable first and second connector units. The first connector unit has at least one electrical pin extending through a bore in a retaining base and projecting outward from the forward end of the base. The second connector unit has at least one electrical socket module which receives a forward portion of the electrical pin when the units are mated. A pin seal device is located in one of the connector units and has a through bore which engages part of the pin at least in the mated condition of the units. The seal device has a first and second seals in sealing engagement with portions of the connector units when mated, and a chamber between the seals extends over an opposing portion of the pin at least in the mated condition of the units.

44 Claims, 17 Drawing Sheets

SUBMERSIBLE CONNECTOR WITH SECONDARY SEALING DEVICE

BACKGROUND

1. Field of the Invention

The present invention relates generally to submersible or harsh environment electrical or electro-optical connectors which can be mated and unmated in a harsh environment, such as underwater, and is particularly concerned with a secondary sealing device for such connectors.

2. Related Art

There are many types of connectors for making electrical and fiber-optic cable connections in hostile or harsh environments, such as undersea or submersible connectors which can be repeatedly mated and demated underwater at great ocean depths. Current underwater connectors typically comprise releasably mateable plug and receptacle units, each containing one or more electrical or optical contacts or junctions for engagement with the junctions in the other unit when the two units are mated together. The contacts on one side are in the form of pins or probes, while the contacts or junctions on the other side are in the form of sockets for receiving the probes. Typically, the socket contacts are contained in a sealed chamber containing a dielectric fluid or other mobile substance, and the probes enter the chamber via one or more sealed openings. One major problem in designing such units is the provision of seals which will adequately exclude seawater and/or contaminates from the contact chamber after repeated mating and demating.

In some known underwater electrical connectors, the receptacle unit has a stopper which is positioned in sealing engagement with an annular end seal when the units are not mated. The chamber sealed by the stopper and end seal contains a circuit contact and dielectric mobile substance. The receptacle unit may have one such contact chamber or plural contact chambers each sealed by respective stoppers in the end seal, depending on the number of connections to be made. As the plug probe enters the chamber, it pushes the stopper back, enters the inner chamber, and makes electrical contact with the circuit connection. At the same time, the end seal will seal against the plug probe to ensure that water cannot enter the chamber. This provides a robust and reliable electrical connector for use in deep sea or other harsh environments. Such connectors are generally known as pin-and socket type connectors and one such connector is described in U.S. Pat. No. 5,645,442 of Cairns. This connector is manufactured and sold by Ocean Design, Inc. under the name Nautilus®. U.S. Pat. No. 6,332,787 of Barlow et al. describes a similar electrical connector arrangement in an electro-optical connector for connecting both electrical and optical circuits.

In a pin-and-socket connector, each plug pin or probe has an elongated shaft enclosed in a dielectric sheath along most of its length, with an exposed conductive tip which contacts the corresponding electrical socket contact in the mated condition. The probe or pin projects forwardly from a dielectric base member in the plug unit so that at least part of the body of the probe is exposed to the surrounding environment when the connector units are unmated. When the pin engages in the contact chamber of the mating receptacle unit, the contact chamber is sealed by the sealing engagement of the end seal with the dielectric sheath of the plug pin or probe.

One problem with such connectors is that the front portion of any electrical pin is partially exposed to seawater in the fully mated condition, potentially increasing electrical stress, and also resulting in degradation of exposed parts of the pin due to extended exposure to seawater.

SUMMARY

Embodiments described herein provide a new submersible electrical or electro-optical connector which has an improved secondary sealing device which reduces exposure of the electrical pin or pins to seawater in the fully mated condition, and also reduces electrical stress on the primary insulator.

According to one aspect, a submersible or harsh environment connector is provided which comprises first and second connector units which are releasably mateable together. In one embodiment, the first connector unit is a plug unit which contains one or a plurality of electrical circuits which terminate in contacts carried on the ends of pins or probes. The second connector unit is a receptacle unit which contains a corresponding number of electrical circuits which terminate in contact sockets which connect with the pin or probe contacts which enter the receptacle unit when the two units are fully mated. The connector may be electrical only, or may be a hybrid electrical and optical connector. In one embodiment, the first connector unit has at least one electrical contact pin which projects from a forward end face of the connector unit, with an exposed contact at the tip of the pin. A pin seal or secondary sealing device is located in one of the connector units and is positioned for engagement over part of the pin at least in the fully mated condition of the connector units. In one embodiment, the pin seal device is located in the first connector unit and extends from the forward face over part of a forwardly projecting end portion of the pin, and has a front end wall with an opening through which the pin projects at least in the mated condition. In a second embodiment, the pin seal device is located in the second connector unit and has a forward end opening positioned to receive the pin when the connector units are moved into mating engagement.

The pin seal device has a first seal in sealing engagement with a part of the connector unit in which it is located, a second seal spaced from the first seal which engages the pin at least in the fully mated condition of the connector units, and a chamber between the seals which encloses part of the pin at least in the fully mated condition. A forward end face of the device seals against an opposing end face of one of the connector units when the units are fully mated, enclosing the underlying portions of the pin extending between the plug and receptacle units in the chamber between the seals.

In one embodiment, the pin seal device is an elongate, generally tubular member having a rear end and a forward end. The first seal is located at the rear end and comprises an annular rim or flange at one end of the tubular member which is retained in a corresponding annular recess in part of the connector unit. The second seal is a front end seal which comprises an inwardly projecting annular ring which is in sealing engagement with an opposing portion of the pin at a location spaced from the rear end seal. The rear and front end seals are connected by a tubular wall portion which is spaced from the opposing surface of the pin to form the seal chamber. In one embodiment, the chamber may be filled with dielectric oil or other mobile substances to form an additional insulator layer between the conductive pin and the ground plane when the plug and receptacle units are mated, and also to provide lubrication to the front seal which allows dynamic movement relative to the pin during the mating and de-mating operation. In other embodiments, the chamber is not filled with a mobile substance.

As noted above, the forward end face of the front end seal is in face-to-face sealing engagement with an opposing surface of one of the connector units when the units are fully mated. In this condition, the pin seal device provides a second insulating barrier to the dielectric sheath or primary insulator of the contact pin. In one embodiment, the wall thickness of the tubular portion of the seal device between the front and rear end seals is reduced to allow some resiliency as the seal member engages an opposing surface of the receptacle unit, so that the seal member can be compressed slightly to apply a sealing force against the opposing surface. Alternatively, or additionally, a spring may be located in the chamber to bias the forward end face against the opposing surface. The flexible or deformable wall portion also applies compensation to the fluid volume inside the pin seal member, should compensation be desired.

In another embodiment, the pin seal device may comprise a housing of rigid material such as plastic or the like, which is slidably mounted in an end member of a respective connector unit, and a spring is mounted in the chamber inside the housing. The forward end wall of the housing is biased against an opposing seal end face of the other connector unit in the mated condition by the spring, which is compressed as the housing is urged rearwardly when the connectors are mated. In this embodiment, the forward end wall has an opening through which the pin projects and a suitable seal such as an O-ring seal is positioned in the opening to seal against the pin. A similar seal is provided at the rear end of the housing between the housing and part of the connector unit in which it is slidably engaged.

The design enhances the state of the art by improving reliability and by reducing exposure of the primary insulator to seawater. The secondary sealing device or pin seal device which provides a seal on each electrical probe or pin provides a second insulating barrier to the individual electrical conductors and their retention base, reducing electrical stress on the primary insulator, i.e. the dielectric outer layer of the probe or pin. The secondary sealing device also provides a low pressure barrier to the opposing face of the mating connector unit in the mated condition.

BRIEF DESCRIPTION OF THE DRAWINGS

The details of the present invention, both as to its structure and operation, may be gleaned in part by study of the accompanying drawings, in which like reference numerals refer to like parts, and in which.

DETAILED DESCRIPTION

Certain embodiments as disclosed herein provide for a submersible or harsh environment connector for simultaneously joining one or more electrical circuits or electrical and optical circuits incorporating a secondary sealing device for each electrical pin or probe. In some embodiments, the connector is a wet mateable connector.

After reading this description it will become apparent to one skilled in the art how to implement the invention in various alternative embodiments and alternative applications. However, although various embodiments of the present invention are described herein, it is understood that these embodiments are presented by way of example only, and not limitation. As such, this detailed description of various alternative embodiments should not be construed to limit the scope or breadth of the present invention as set forth in the appended claims.

Figure 1:
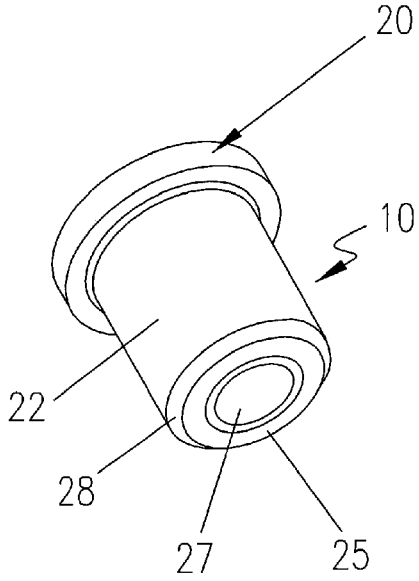
FIG. 1 is a front perspective view of one embodiment of a secondary sealing device or pin seal device for sealing part of the projecting end portion of an electrical pin or probe in a submersible or harsh environment connector.
Figure 2:
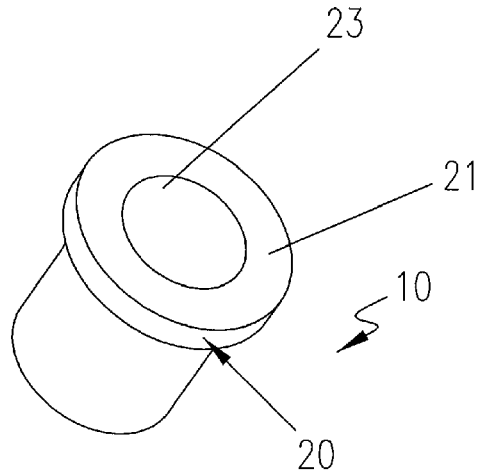
FIG. 2 is a rear perspective view of the pin seal device of FIG. 1.
Figure 3:
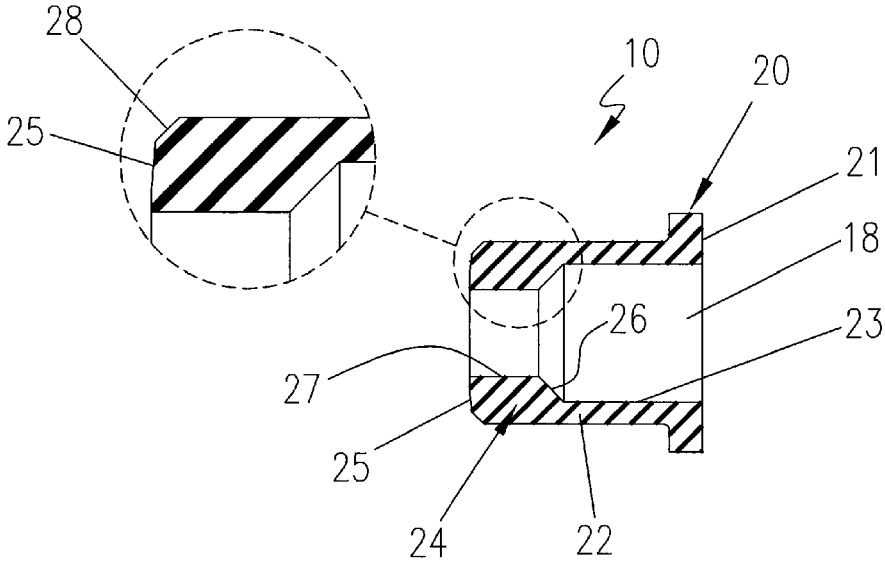
FIG. 3 is a longitudinal cross-sectional view of the pin seal device of FIGS. 1 and 2.
Figure 4:
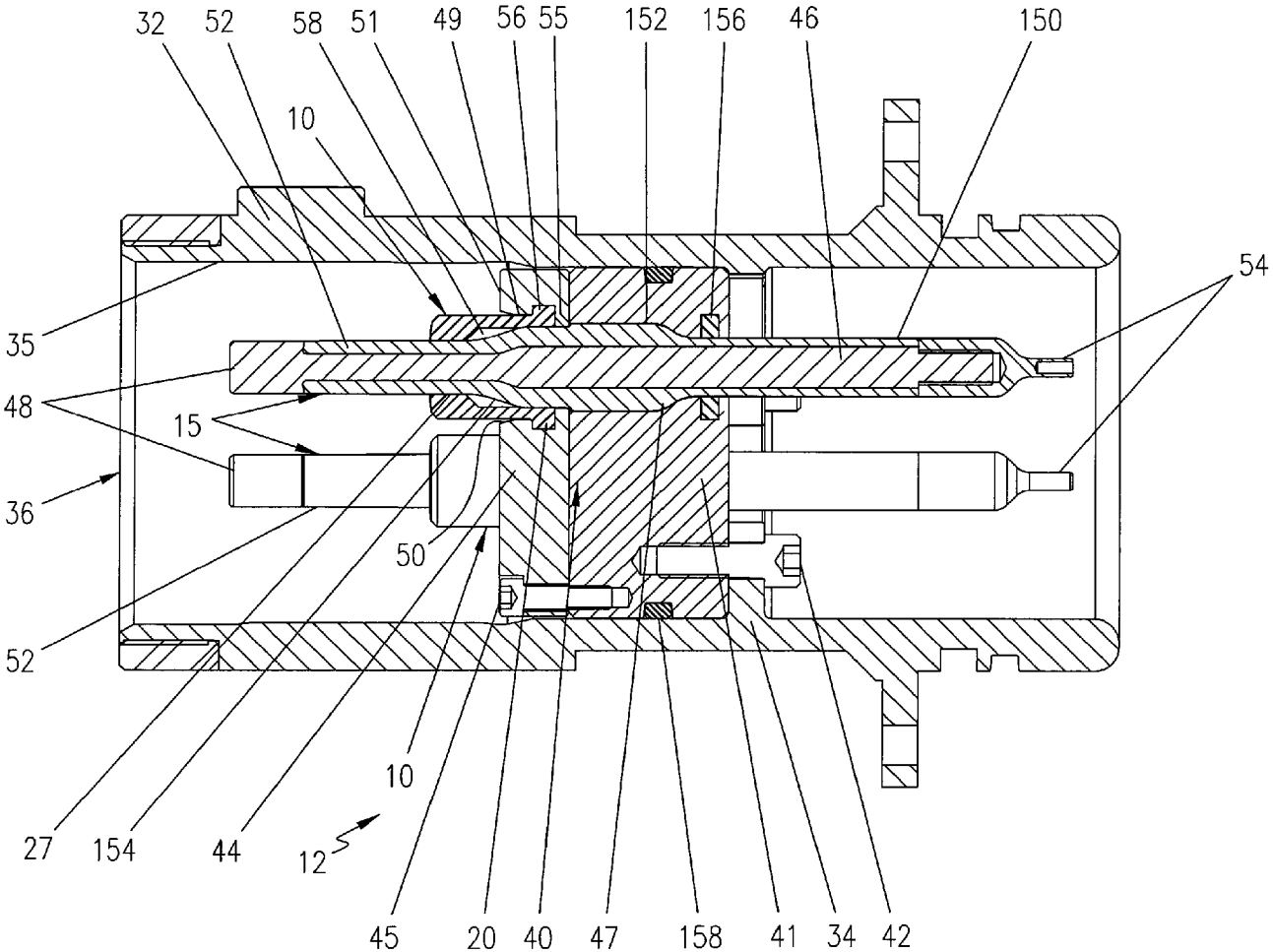
FIG. 4 a longitudinal cross-sectional view of a plug or first connector unit of one embodiment of a submersible connector incorporating the pin seal device of FIGS. 1 to 3.
Figure 5:
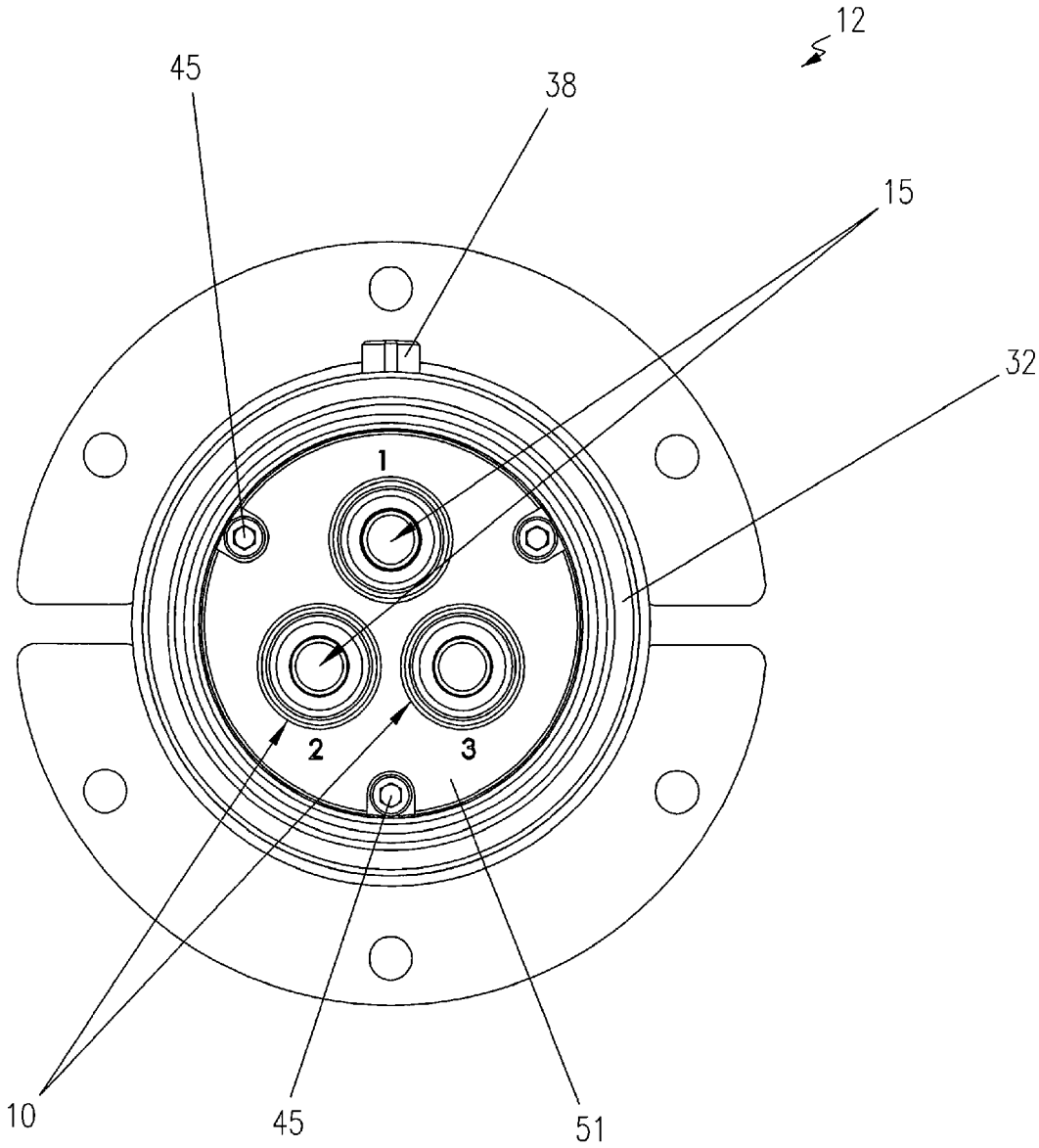
FIG. 5 is a front end view of the plug unit of FIG. 4.
Figure 6:
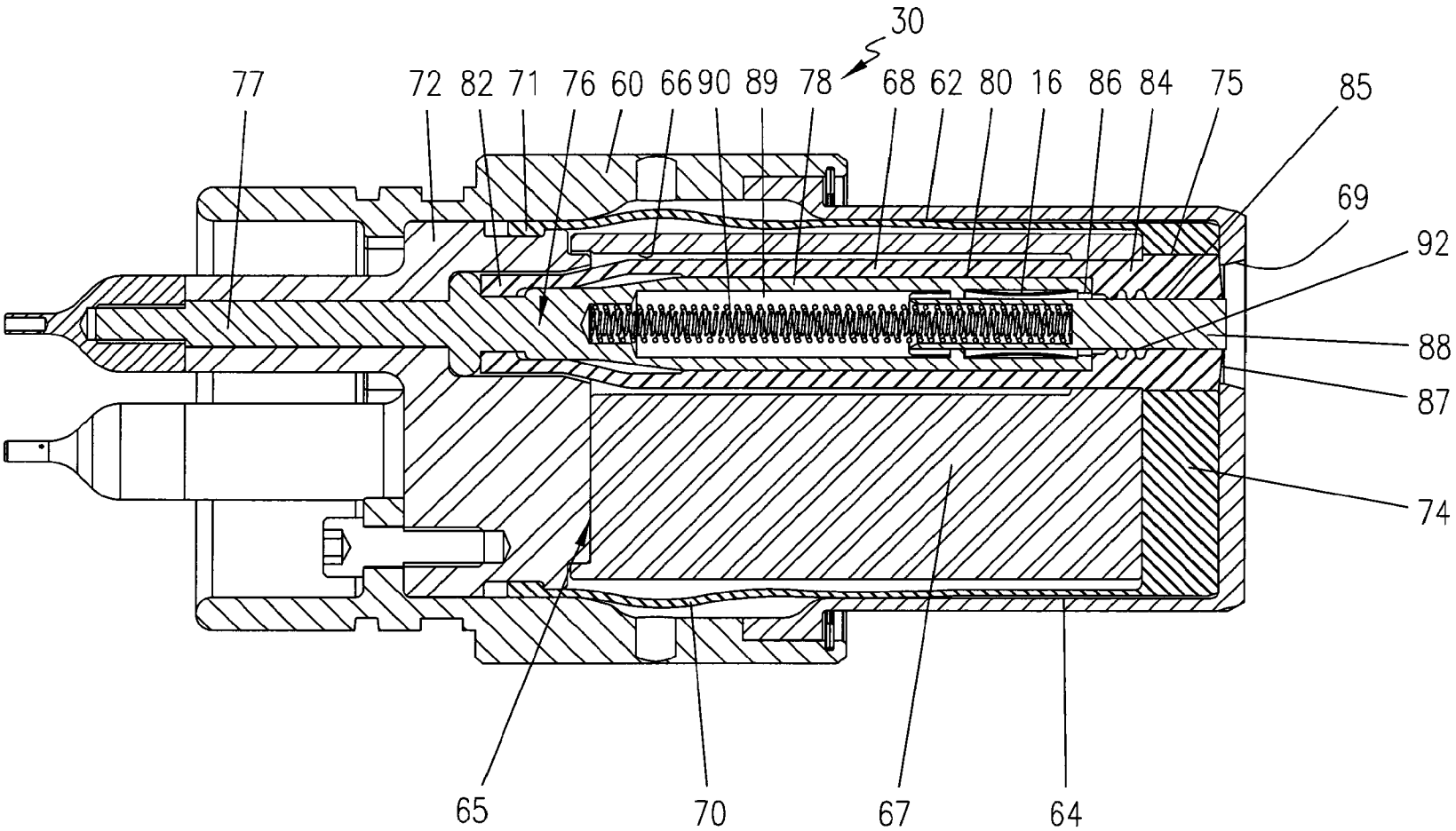
FIG. 6 is a longitudinal cross-sectional view of a receptacle or second connector unit for releasable mating engagement with the plug unit of FIGS. 4 and 5.
Figure 7:
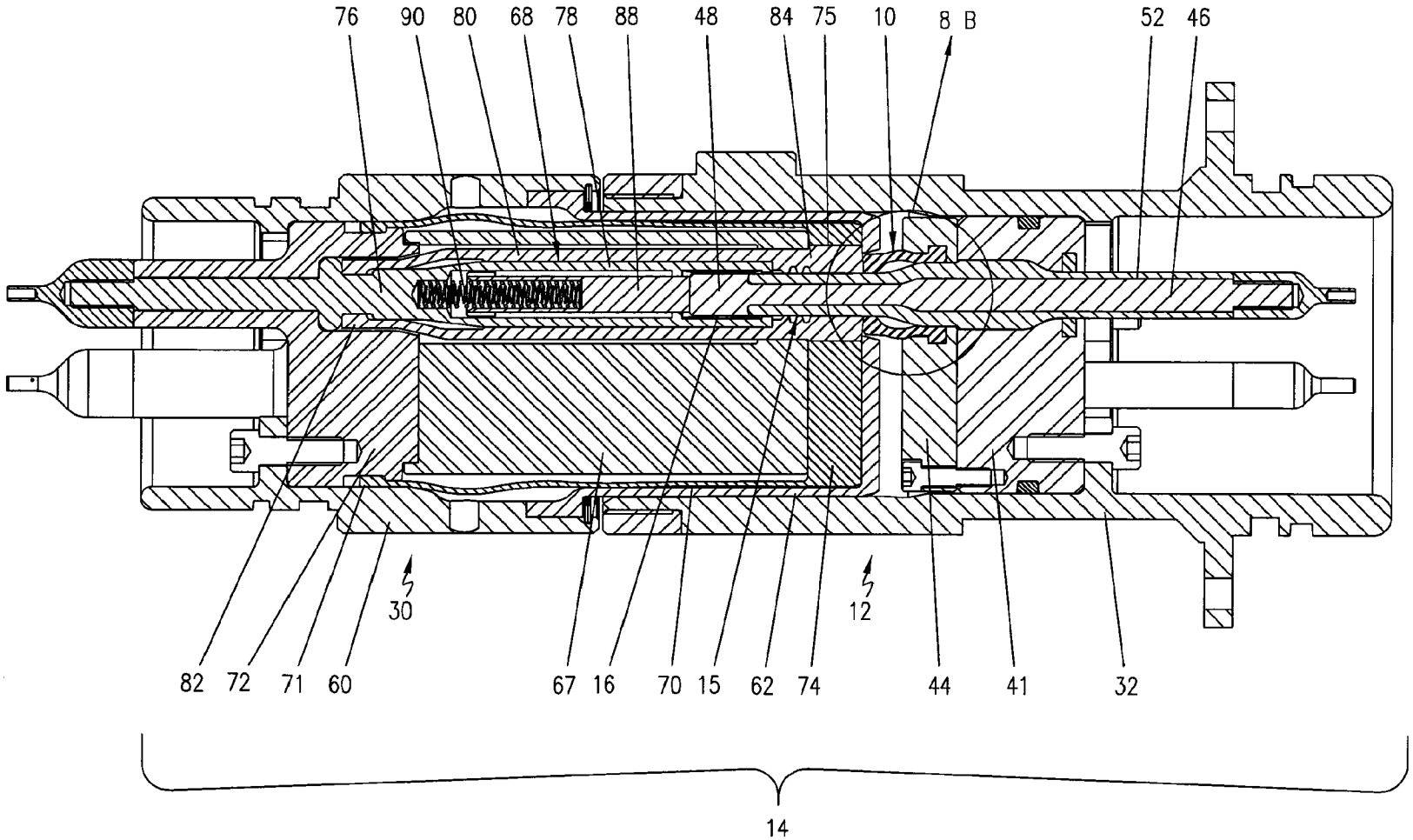
FIG. 7 is a longitudinal cross-sectional view illustrating the plug and receptacle units of FIGS. 4 to 6 in a fully mated condition.

FIGS. 1 to 3 illustrate one embodiment of a secondary sealing device or pin seal device 10 for the pin of a pin-and-socket electrical or hybrid electro-optical connector, while FIGS. 4 and 5 illustrate the pin seal device installed in a first connector unit or plug unit 12 of one embodiment of such a connector. FIG. 6 illustrates a second connector unit or receptacle unit 30 for mating engagement with plug unit 12, and FIG. 7 illustrates the entire connector 14 with the plug and receptacle units of FIGS. 4 to 6 in a fully mated condition. The illustrated connector has three spaced electrical pins or probes 15 and aligned electrical sockets 16, with a separate pin seal device 10 engaged with each of the electrical pins 15. Only one pair of pin and socket connections are illustrated in detail. The other electrical circuit connections in the connector are identical to the illustrated pair. In alternative embodiments, the secondary or pin seal device 10 may be provided in an electrical connector having a greater or lesser number of pin and socket connections, including an electrical connector having only a single pin and socket pair, or with or on electrical pins of an electro-optical connector, such as the electro-optical connector described in U.S. Pat. No. 6,332,787 of Barlow et al., the contents of which are incorporated herein by reference. In other embodiments, the secondary seal device may be mounted in the second connector unit or receptacle unit, rather than the plug unit, for example as described below in connection with FIGS. 10 and 11, or a modified secondary seal device may be designed to engage over more than one pin, for example as described below in connection with the embodiments of FIGS. 14 to 17. The secondary or pin seal device 10 may be provided in suitable dimensions for sealing over electrical pin or probe contacts of different dimensions, depending on the connector in which it is to be installed.

As best illustrated in FIGS. 1 to 3, the pin seal device 10 is generally tubular in shape, with a rear end seal 20 and a front end seal 24 connected by a tubular wall portion 22 of reduced thickness. Pin seal device 10 has a through bore 18 of stepped diameter, a generally cylindrical outer surface with an annular, outwardly projecting flange or rim forming rear end seal 20, and an annular inner projection or ring at its forward end which forms front end seal 24. The through bore 18 has a larger diameter portion 23 extending from the first or rear end 21 along more than half of the length of the seal, and a smaller diameter portion 27 extending up to the second or front end face or annular end face 25, with the two portions connected by a tapered or angled step portion 26. The outer rim of the front end face is chamfered, as indicated at 28 in FIGS. 1 and 3. The annular end face 25 is slightly tapered outwardly from its outer edge to its inner edge, as best seen in FIG. 3, so as to form a frusto-conical annular surface. The seal device 10 is formed from a suitable elastomeric material such as natural rubber or other rubber or rubber-like material, including Fluorosilicone elastomeric materials, low durometer plastics materials, and the like.

Figure 8A:
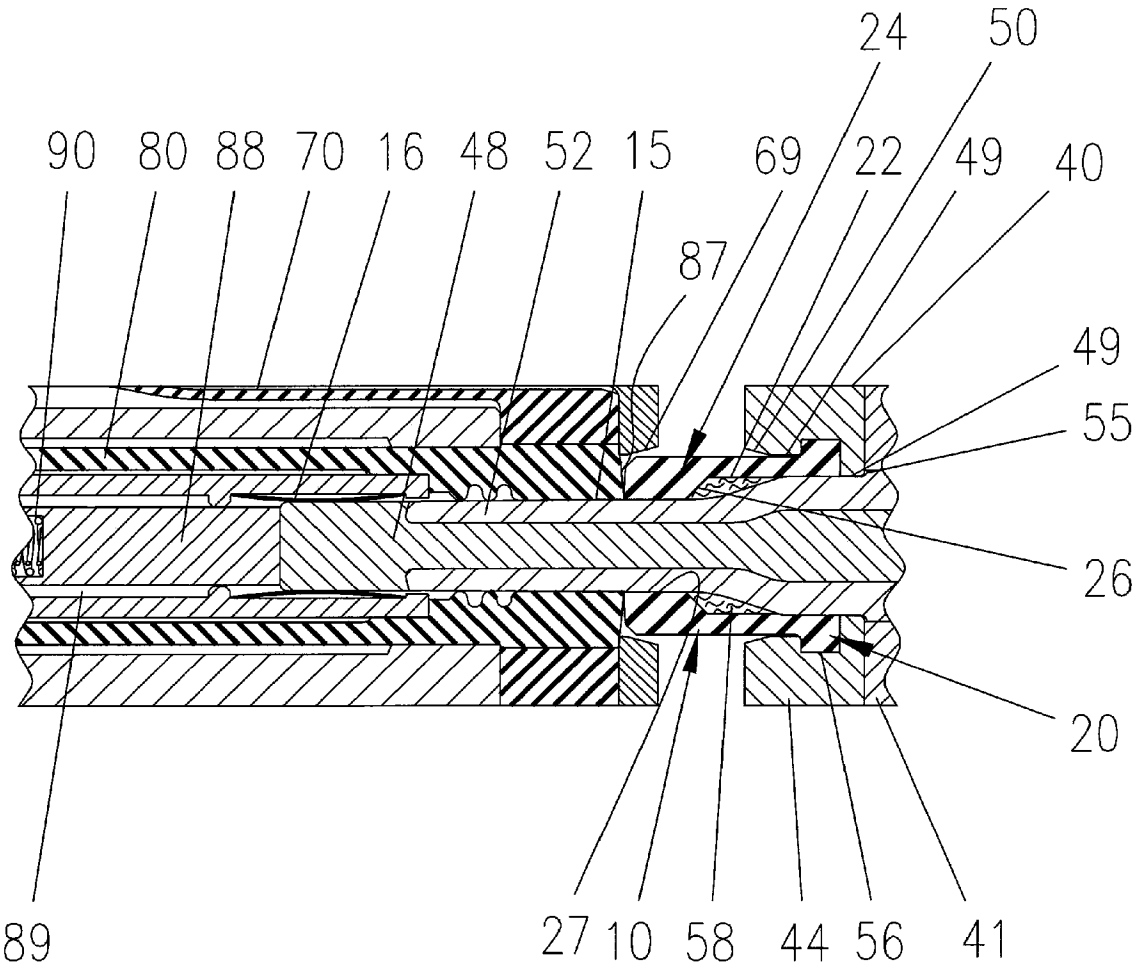
FIG. 8A is an enlarged partial cross-sectional view of part of the mating ends of the plug and receptacle units illustrating a plug pin engaging a receptacle contact socket prior to fully mating with the socket, at the point where the forward end of the pin seal device engages an opposing surface of the end seal of the receptacle contact chamber.

As noted above, FIGS. 4 to 8 illustrate a harsh environment, pin and socket electrical connector 14. The connector comprises a first connector unit or plug unit 12 as illustrated in FIGS. 4 and 5 and a second connector unit or receptacle unit 30 as illustrated in FIG. 6. The units are illustrated in a fully mated condition in FIGS. 7 and 8B, with FIG. 8A illustrating the mating ends of the units just prior to full mating engagement, so as to better illustrate the operation of the pin seal devices 10 which are installed on each pin or probe 15 of the plug unit 12. Apart from the modification of the plug and receptacle units to accommodate the pin seal devices 10, the connector 14 is similar in some respects to the harsh environment or underwater connector described in U.S. Pat. No. 5,645,442 of Cairns, the contents of which are incorporated herein by reference.

The first connector unit or plug unit 12 comprises an outer cylindrical shell 32 of rigid material having a sealed rear end wall 34, a through bore 35 and an open forward end 36. A conventional alignment key 38 projects radially outwardly from the shell 32, as best illustrated in FIG. 5. When the plug and receptacle units are secured together, key 38 will engage in an axial alignment keyway in the receptacle, as is known in the field. This provides proper alignment of the electrical pins and sockets in the plug and receptacle units as the units are mated together.

In this embodiment, a two part base 40 for guiding and retaining the electrical pins is secured in shell through bore 35. The first part comprises a plug or base member 41 of rigid material secured in the bore 35 via suitable fastener screws 42 which secure the base member 41 to rear end wall 34. The second part comprises a retaining member 44 which is secured to the front of the base member 41 via fastener screws 45. The base member 41 and retaining member 44 have aligned through bores 47, 49 through which respective electrical probes or pins 15 project. As best illustrated in FIGS. 4 and 8, the forward end portion 50 of the through bore 49 in retaining member tapers outwardly up to the forward end face 51 of the retaining member. The base and retaining member may be of any suitable rigid material, such as titanium, plastic, or the like. The plug base 40 has an outer or forward end face 51 which faces an opposing end face of the second connector unit or receptacle unit when the units are moved into mating engagement, as described in more detail below.

Each pin or probe comprises a conductive probe shaft 46 extending through the aligned bores and terminating in a conductive tip or contact 48. Shaft 46 has an outer protective tubular layer or casing 52 of dielectric material which forms a primary insulator which extends along most of the length of the pin, terminating short of the conductive tip 48. The rear end 54 of each pin is suitably attached to a conductive wire at the end of an electrical cable in a conventional manner. The casing 52 is of stepped diameter, with a reduced diameter rear end portion 150, an enlarged diameter intermediate portion 152 extending from the base member through bore 47 into the retainer member through bore 49, and a tapered step 154 at the forward end of retainer member 44 leading to a reduced diameter forward end portion which projects forward out of the retainer member through bore 49. The through bore in the base member is of similarly stepped diameter for close engagement with the different diameter portions of the casing, as seen in FIG. 4. The intermediate portion 152 of the casing has a small annular step or lip 55 at the junction between the base and retainer member through bores, and is held in the base by the engagement of lip 55 with the rear end face of the retainer member, as seen in FIGS. 4 and 8. An O ring seal 156 is provided in the base member through bore for sealing engagement with the pin, and a second O-ring seal 158 is provide between the outer surface of the base member 41 and the inner surface of the plug shell.

As best illustrated in FIG. 4, a pin seal device 10 is engaged over a forward portion of each pin with the rear end seal or annular rim 20 seated in annular seat or indent 56 in the through bore 49 which extends through the retaining member 44. The seal device 10 extends forward from seat 56 and out through the tapered or flared forward end portion 50 of through bore 49. The inner bore portion 27 of the front end seal 24 is of suitable dimensions for sealing engagement with the opposing outer surface of the outer dielectric casing 52 of the pin in the unmated condition of FIG. 4. At the same time, the enlarged diameter wall portion 22 of the seal through bore is spaced from the underlying surface regions of the pin casing 52 so as to define a chamber 58 between the seal bore and casing. In one embodiment, the chamber 58 is filled with a mobile substance such as oil or water. The compensating fluid or other mobile substance in chamber 58 is prevented from escaping by the sealing engagement of seal inner bore portion 27 with the outer surface of the pin.

The annular flange or rear seal 20 of the pin seal device is a gland seal forming a seal between the retaining base and pin. In the unstressed condition prior to installation, the inner diameter of the seal through bore at rear end seal 20 is less than the outer diameter of the intermediate portion 152 of the pin casing over which it engages in use. At the same time, the outer diameter of the annular flange or rear end seal 20 in the unstressed condition is greater than the inner diameter of the seat 56 in which it engages. In the installed position of FIG. 4, the seal is squeezed between the opposing surfaces of the seat 56 and portion 152, producing a bi-directional sealing engagement between opposing surfaces of the seal flange and seat and opposing surfaces of the seal through bore and the outer casing of the pin. The tolerances between the rear seal 20 and the seat 56 are such that there is a slight clearance between the rear seal 20 and annular seat 56 when engaged as in FIG. 4, so as to allow compensation of the small amount of fluid or other mobile substance inside the plug module.

The mating second connector unit or receptacle unit 30 is illustrated in more detail in FIG. 6 and has an outer shell 60 with a smaller diameter forward end portion 62 for slidable engagement in the open forward end portion of the plug through bore 35. The shell has a through bore 64 in which a two part receptacle manifold or body 65 is mounted. Receptacle body 65 has a base part 72 and forward part 67 in which electrical sockets 16 are located. A plurality of through bores 66, extend through the body, and respective electrical socket modules 68, one of which is seen in FIG. 6, extend through the respective bores 66. In this embodiment, three electrical socket modules are provided and positioned in alignment with the corresponding electrical pins 15 of the plug module when the units 12, 30 are in mating engagement. The shell 60 has a forward end wall with flared openings 69 aligned with the respective through bores 66. An outer bladder 70 of flexible elastomeric material has a first end 71 secured to a base part 72 of the receptacle body 65 at one end, and extends forwardly over the forward part 67 of the manifold, terminating in an end seal 74 located between the forward end of the manifold and the forward end wall of shell 60, as seen in FIG. 6. End seal 74 has openings 75 aligned with the respective through bores 66 and openings 69. The receptacle unit has an end face which opposes the end face of the mating plug unit as the units are moved into mating engagement. The end face of the receptacle unit comprises the forward end wall of the receptacle shell and the forward end of each socket module end seal 74.

As illustrated in FIG. 6, socket module 68 includes a conductive member 76 having a rear or base portion 77 secured in the rear end of the through bore in base part 72, and a tubular portion 78 extending forward from the base portion. Electrical socket or contact band 16 is located in the forward end of tubular portion 78. A second or inner bladder 80 of flexible elastomeric material has a rear end 82 secured to the base portion 77 of the conductive member, and extends forward from end 82 over the tubular portion of the conductive member. Bladder 80 forms an electrical contact chamber within which the electrical socket structure is disposed, and terminates in end seal 84 which is in sealing engagement with the open end 75 of the outer bladder end seal 74. End seal 84 has a through bore or passageway 85 aligned with a forward end opening 86 in the tubular portion 78 of the conductive member, and with opening 69 in the forward end wall of the receptacle shell. The annular front end face 87 of end seal 84 is slightly tapered from its outer to its inner edge, to form a slight frusto-conical shape, as illustrated in FIG. 6. A movable dielectric stopper 88 is slidably mounted in the forward end of tubular portion 78 of the electrical socket module, and is biased into the extended position of FIG. 6 by spring 90. In the extended position, the stopper is in sealing engagement with the passageway 85 in bladder end seal 84, so as to seal the contact chamber 89 inside tubular portion 78. The end seal 84 exerts a radially constrictive sealing force on the stopper, forming a mobile substance and pressure resistant barrier.

The passageway 85 in end seal 84 has one or more inner annular ribs or corrugations 92 which define annular chambers or regions containing dielectric fluid or other mobile substance surrounding stopper 88, as described in U.S. Pat. No. 5,645,442 referenced above. The receptacle unit 30 is similar to prior art receptacle units for pin and socket electrical connectors, except that the end wall openings 69 aligned with the plug module pins 15 are enlarged to accommodate the pin seal devices 10, as described in more detail below. The end wall openings 69 are also tapered outwardly from the inner to the outer side of the end wall, as illustrated in FIG. 6.

Inner and outer bladders 70, 80, may suitably be made of a natural or synthetic rubber material. The chamber within the bladder 80 is filled with a dielectric fluid or mobile substance of the type described in previous U.S. Pat. No. 5,645,442 referred to above. The outer chamber within outer bladder 70 which surrounds all of the electrical socket modules is also oil-filled and pressure-compensated. The conductive socket and other conductive elements are all sealed within the dielectric chamber inside bladder 80, with the inner and outer bladders expanding or contracting to compensate for pressure changes inside and outside the chamber.

The mating sequence of the plug and receptacle units is described below with reference to FIGS. 7 and 8. As noted above, the plug and receptacle units are shown in their unmated condition in FIGS. 4 and 6, respectively, and each dielectric stopper 88 is located in sealing engagement with the end seal 84 of each of the electrical socket modules 68. As the two units are brought together with their front ends facing one another, the forward end portion 62 of the receptacle shell starts to enter the bore 35 at the front end of the plug shell, assuming that the key 38 (FIG. 3) is properly lined up with the keyway (not visible in the drawings) in the receptacle shell. As the portion 62 continues to travel into the plug shell 32, the conductive tips 48 of pins or probes 15 will enter openings 69 in the front wall of the receptacle shell and engage the forward ends of the aligned dielectric stoppers 88. Continued movement of the receptacle shell into the plug shell will cause the electrical probes to push the stoppers inwardly, compressing springs 90, until each conductive tip 48 is in electrical contact with the respective contact band or socket 16, establishing electrical connection between the plug and receptacle units. At the same time, the forward end of each pin seal device 10 enters the respective end wall opening 69 and contacts the front end face 87 of the inner bladder end seal 84, as seen in FIG. 8A. The end wall opening diameter is sufficiently large to provide a clearance between the opening and the forward end of the pin seal device.

FIG. 8A illustrates the position of one electrical probe or pin 15 when the end face 25 of the pin seal device 10 has just contacted the end face 87 of bladder end seal 84. As noted above, both annular end faces 25 and 87 are slightly frusto-conical in shape, so that they first make contact at their central regions, adjacent the aligned openings through which the pin 15 extends. This forms an annular groove which is V-shaped in cross section, as seen in FIG. 8A. At this point, the conductive tip 48 is not fully engaged in socket 16. The receptacle shell is moved inwardly from this point until the units are fully mated. This causes the connecting tubular wall portion 22 of the pin seal 10 to deform outwardly, as seen in FIGS. 7 and 8B, with the flared forward end portion 50 at the outer end of the retainer member through bore 49 accommodating the deformation, as the forward end portion of the pin continues to slide through the front end seal 24 until the conductive tip 48 is fully engaged with the mating socket or contact band 16.

Figure 8B:
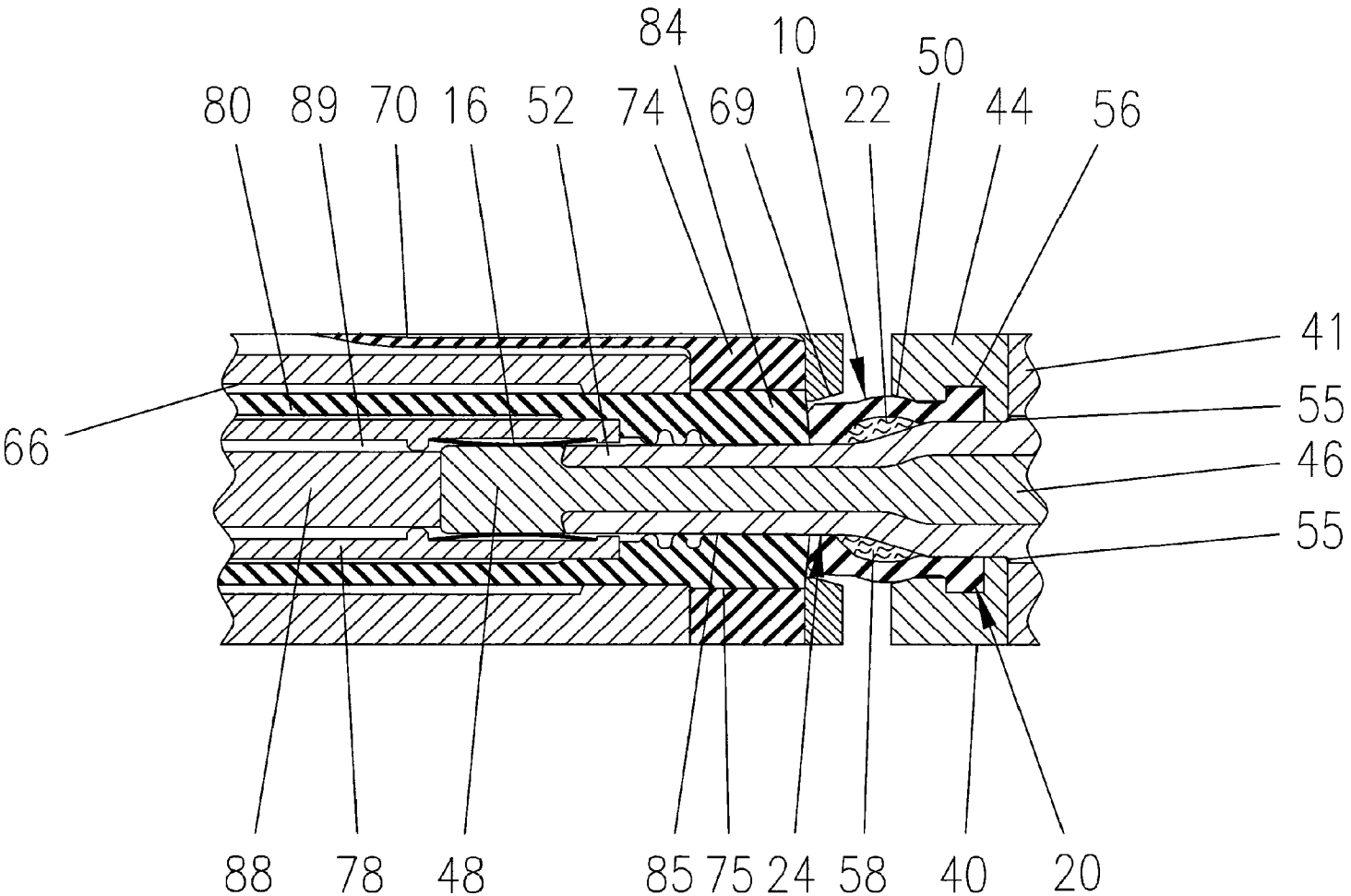
FIG. 8B is an enlarged partial cross-sectional view similar to FIG. 8A and generally corresponding to the circled area of FIG. 7, illustrating the fully mated condition.

At the same time, deformation of the pin seal causes the end face 25 of the front end seal to be deformed and pressed into face-to-face engagement with the opposing end face 87 of bladder end seal 84, as seen in FIG. 8B. The resiliently deformed wall portion 22 provides a biasing mechanism which applies a sealing or biasing force to the front end seal 24 to urge it against the opposing front end face of the bladder end seal 84, activating the sealing engagement between these parts. In the fully mated condition of FIG. 8B, the part of pin 15 extending between opposing end portions of the connector units 12 and 30, which would otherwise be exposed in the fully mated condition, is completely surrounded by the pin seal device 10 including part of chamber 58. Any standard coupling device known in the field may be used to retain the connected plug and receptacle units in the mated condition of FIGS. 7 and 8B.

The pin seal device 10 provides multiple sealing locations when the plug and receptacle units are mated and acts as a secondary electrical barrier to the primary insulator or outer dielectric casing 52. The multiple sealing locations are the rear end seal 20, the reduced thickness wall portion 22, the oil or other compensating fluid or other mobile substance in chamber 58, and the front end seal 24. The first seal or sealing location at rear seal 20 provides a seal to the retaining member 44 and pin 15 in both the mated and unmated condition of the plug unit. This arrangement transfers the force required to activate the seal on engagement with the receptacle to the retaining member 44. This sealing engagement also acts to seal the rear end of chamber 58 inside the seal, sealing the compensating fluid or other mobile substance inside the pin seal device. The end flange engagement in seat or indent 56 also retains the pin seal device on the pin during the de-mating operation, and permits compensation of the mobile substance inside the plug module due to the slight clearance between the end flange and seat.

The second seal or sealing location of the pin seal device 10 is the front end seal 24 which provides sealing engagement to the front of the pin in the unmated condition of FIG. 4, inhibiting oil escape from chamber 58 as well as sea water entry into chamber 58. The front end seal 24 also provides a seal to the receptacle unit in the mated condition of FIGS. 7 and 8B, where the front end face 25 is in sealing engagement with the front end face of the bladder end seal 84 and is biased against the opposing end face by the resilient deformation of wall portion 22. As can be seen by comparison of FIGS. 8A and 8B, the pin slides relative to front end seal 24 as it moves into the fully mated position of FIG. 8B. The sliding of the inner surface 27 of the front end seal 24 along the outer surface of the pin casing 52 deforms wall portion 22, and also has a squeegee-like effect, shedding water or debris rearward and away from the receptacle contact chamber during the mating operation. At the same time, the gradual squeezing of the front end face 25 of the pin seal device against the opposing end face 87 of the end seal 84 from the center to the outside edge as the V-groove of FIG. 8A is closed has a similar squeegee effect which tends to shed water and debris outwardly and away from the seal openings.

The third sealing location of the pin seal device is the reduced thickness wall portion 22 extending between the end seals 20 and 24. The wall portion 22 acts to reduce electrical stress on the primary insulator or outer casing 52 by providing a second insulating barrier to the ground plane. It also provides resiliency to the wall of the compensating chamber 58 formed inside the seal when engaged over the pin as illustrated in FIG. 4, and applies the sealing force to urge the front end face of the seal device into sealing engagement with the opposing end face 87 of the end seal 84, as seen in FIG. 8B. The resilient wall also provides pressure compensation to the oil volume inside the pin seal device. The fourth seal location provided by pin seal device 10 is the oil or other compensating mobile substance inside chamber 58. This further reduces electrical stress on the primary insulator by providing a third insulator between the conductor and the ground plane, and also provides lubrication to the front seal 24 during the mating and demating operations, where the seal must slide over part of the pin outer casing to accommodate movement into and out of the fully mated position of FIG. 8B. The oil chamber also permits the rubber material of the seal to deform from the mating operation, and provides compensation to the pin seal device.

The thickness of the front end seal 24 at sealed end faces 25, 87 increases the tracking distance from the outer surface of conductive probe shaft 46 to the ground plane or seawater surrounding the connector. In prior art Nautilus® connectors, the distance from the conductor member in the pin to the surrounding sea water as it is mated with the receptacle socket is equal only to the thickness of the dielectric cover member (i.e. outer casing or layer 52). As illustrated in FIG. 8B, the front end seal 24 which seals against the front end face 87 of the end seal of the receptacle end seal module increases this tracking distance by a distance approximately equal to the wall thickness of front end seal 24.

As noted above, the receptacle unit is adapted to accommodate the pin seal device or devices 10 by enlarging the openings in the front end wall of the receptacle shell so that the front end of the pin seal device can extend into the aligned opening and into sealing engagement with the front end face of the opposing receptacle socket module, while leaving a clearance between the front end wall opening 69 and the outer surface of the front end seal 24. The tapered surface of opening 69 and the chamfered outer rim 28 of the front end face of pin seal device help to align the parts during mating, while the clearance provided between these parts helps to prevent hydro-locking once mated.

Figure 9A:
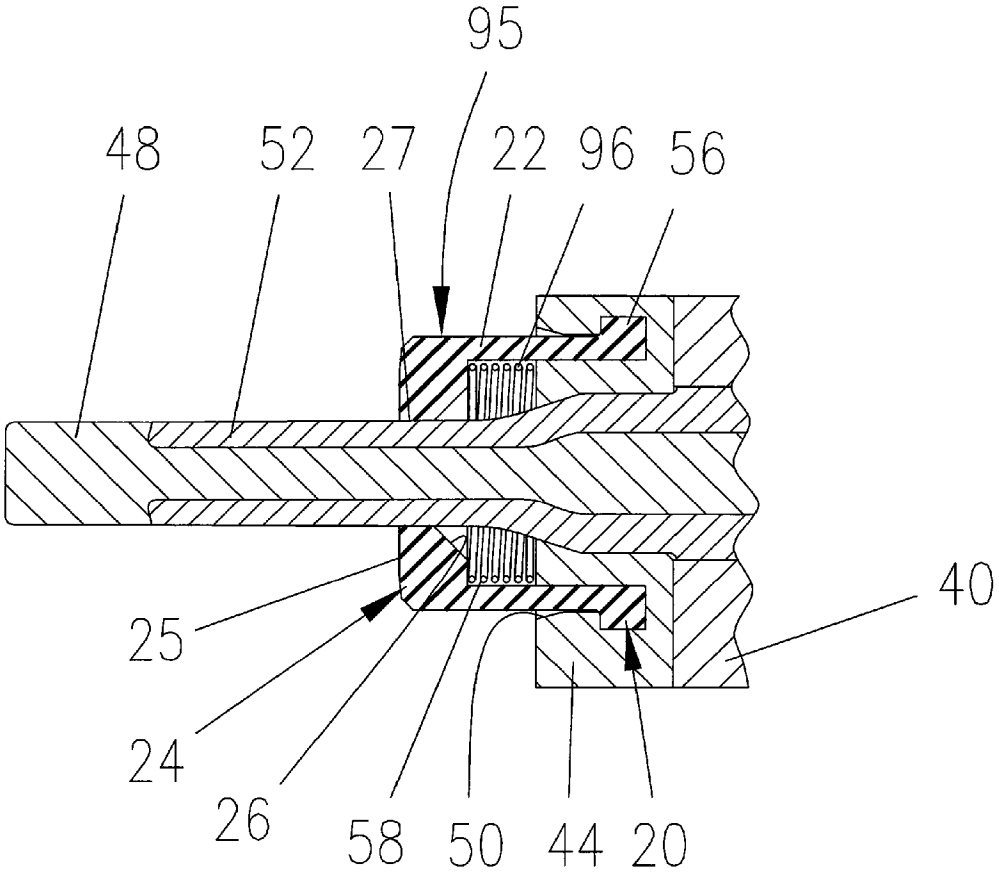
FIG. 9A is an enlarged cross-sectional view of part of the front end of a plug unit with a modified pin seal device mounted over the pin or probe in place of the pin seal device of the previous embodiment.
Figure 9B:
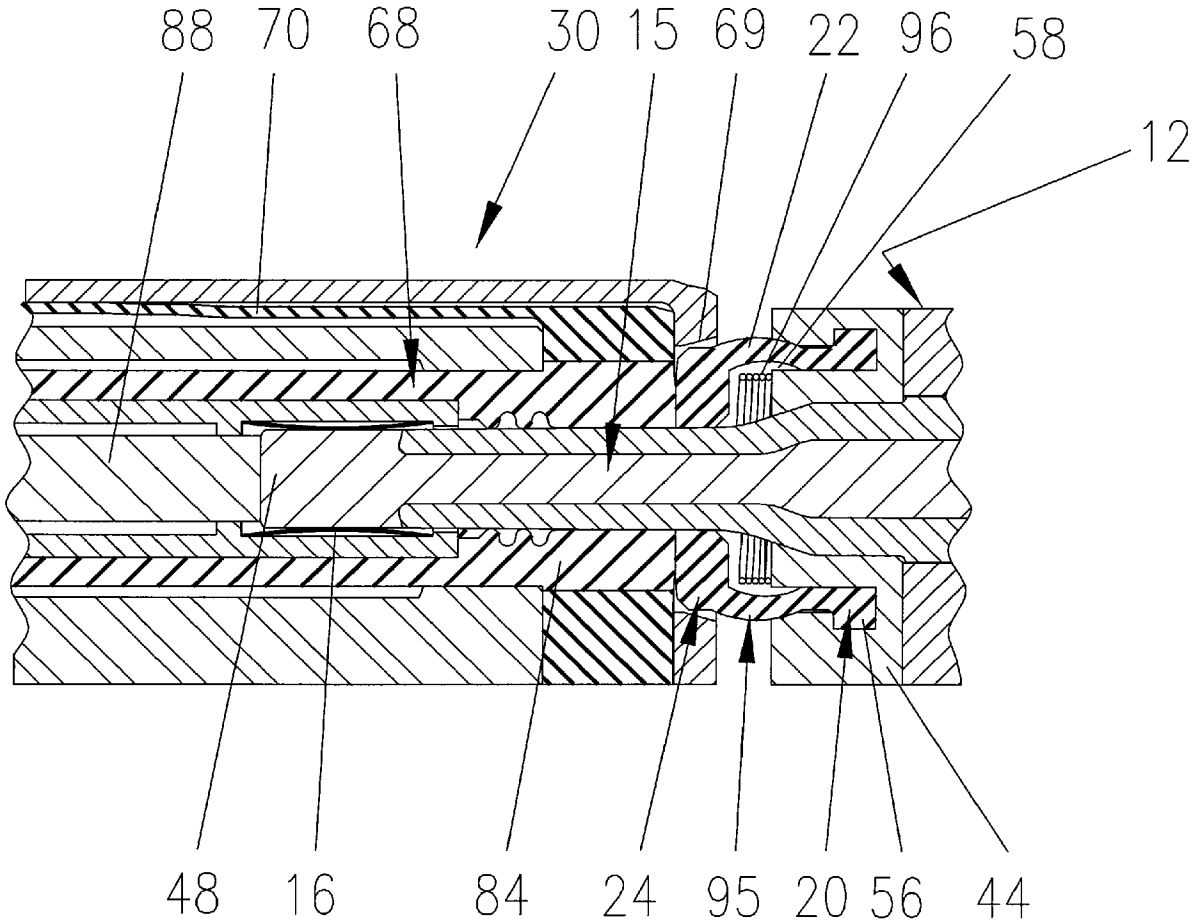
FIG. 9B is an enlarged partial-cross sectional view similar to FIG. 8B but illustrating the fully mated condition of the connector units with the pin seal device of FIG. 9A replacing the pin seal device of FIGS. 8A and 8B.

FIGS. 9A and 9B illustrate a modified pin seal device 95 which is similar to the pin seal device 10 of FIGS. 1 to 8B, and like reference numbers are used for like parts, as appropriate. Pin seal device 95 is of enlarged diameter but is otherwise similar in shape to the pin seal device 10. The enlarged diameter provides an internal chamber 58 which is also of enlarged diameter relative to the chamber in pin seal device. The enlarged diameter provides room to accommodate a biasing spring 96 inside the chamber. The biasing spring augments the biasing force produced by the deformed resilient wall portion 22 when the connector or plug unit 12 is mated with a receptacle unit 30 as indicated in FIG. 9B. As the forward end of the pin 15 is pushed into the open forward end of the receptacle socket unit or module 68, the forward end face 25 of the pin seal device 95 engages the opposing end face of the front end seal 84 of the aligned receptacle socket unit. When the units are moved into mating engagement, the front end of the seal device 95 is urged rearward, compressing spring 96 and also deforming the resilient, deformable wall portion 22 of the seal device. The deformed wall portion 22 and the compressed spring 96 apply a biasing force urging the front end of the seal device into sealing engagement with the opposing face of end seal 84. The modified seal device 95 therefore provides an additional sealing force and added resiliency to the connection.

The pin seal or secondary sealing device of the above embodiments is an integrally formed elastomeric seal member which provides multiple sealing locations and acts as a secondary seal to the existing pin and socket sealing arrangement, and also provides a secondary electrical barrier to the primary electrical barrier or dielectric casing of the electrical probe or pin on which it is engaged. The secondary sealing device reduces electrical stress on the primary conductor, and the electrical stress is further reduced by introduction of a fluid or other mobile substance into the chamber formed between the reduced thickness wall portion 22 of the seal device and the opposing outer surface of the pin casing 52. Testing of an exemplary pin seal device indicates that a water filled front pin seal device may produce up to 3.5 times improvement in electrical stress over an arrangement with no front pin seal or secondary sealing device, while an oil-filled pin seal chamber may produce up to 5.4 times improvement in the electrical stress, based on electric field plots under these conditions. The seal chamber 58 is not required to retain oil, and it may be possible for the oil to transfer with water in some conditions, while still reducing electrical stress on the electrical conductor.

Figure 10:
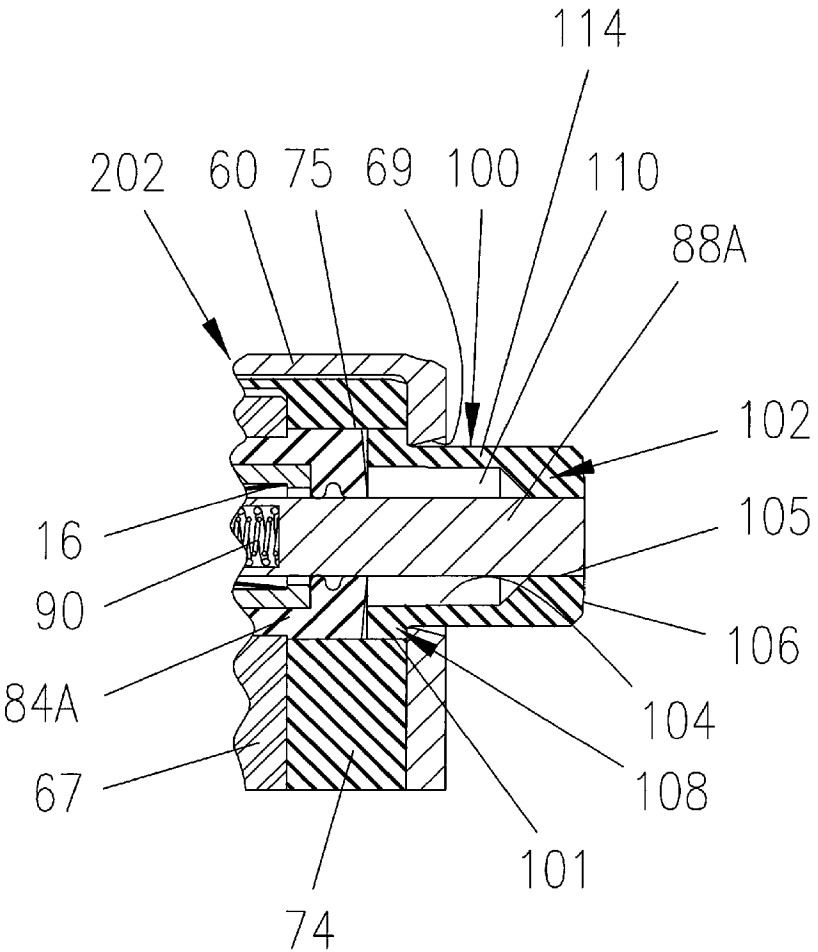
FIG. 10 is an enlarged cross-sectional view through part of a front end portion of a modified receptacle or second connector unit illustrating an alternative embodiment in which a modified pin seal device is installed in the receptacle unit rather than the plug unit.
Figure 11:
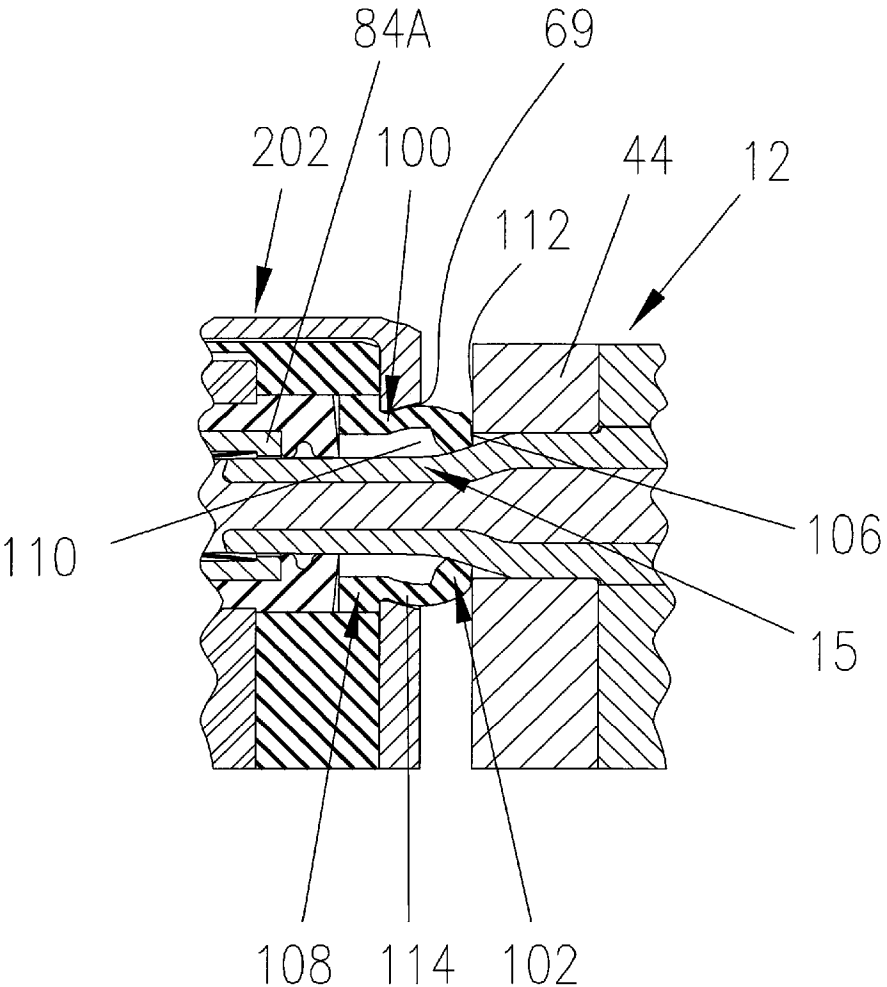
FIG. 11 is an enlarged cross-sectional view of part of the mating ends of the receptacle unit of FIG. 10 and a plug unit.

The pin seal device of the above embodiments is provided in the plug unit of an electrical connector. However, a similar pin seal device may alternatively be located in the receptacle unit for engagement with a pin of a mating plug unit when the units are moved into mating engagement. FIGS. 10 and 11 illustrate one embodiment of a connector incorporating at least one pin seal device 100 in a receptacle unit or connector unit 202 which has a modified front end for mounting of pin seal device 100. Some parts of the connector unit 202 are identical to the receptacle unit 30 of the previous embodiment, and like reference numerals have been used as appropriate. FIG. 10 illustrates part of the front end of receptacle unit 202 in an unmated condition. The pin seal device 100 in this embodiment is similar to that of the previous embodiments, but instead of being installed in the plug unit to extend over part of the pin in the unmated condition, it is installed in the front end of the modified receptacle unit 202 so as to extend over a projecting end portion of the stopper 88A in the unmated condition.

As illustrated in FIG. 10, the receptacle stopper 88A in this embodiment is extended so that, in the unmated condition, it projects forward from the front end of end seal 84 and through the aligned opening 69 in the forward end wall of the receptacle shell 60. As in the previous embodiment, the pin seal device 100 is formed in one piece out of a suitable elastomeric material. Pin seal device 100 has a front end seal 102, a rear end seal in the form of an annular flange 108, a through bore 104 with a reduced diameter forward end portion 105 which is in sealing engagement with the stopper 88A in the unmated condition, and a front end face 106 forming a first end seal. The pin seal device 100 is installed over stopper 88A with the annular flange 108 at its rear end engaged in an annular recess 101 provided between the front end of end seal 84A and the forward end wall of shell 60 adjacent opening 69. The remainder of seal device 100 projects out through opening 69 over the projecting end of stopper 88A with the forward end portion 105 of the through bore in sealing engagement with the forward end of the stopper. In the extended position of FIG. 10, the front end seal 102 exerts a radially constrictive sealing force on the stopper, forming a mobile substance and pressure resistant barrier.

In the unmated condition illustrated in FIG. 10, a chamber 110 is formed between the seal device and stopper 88A behind the forward end portion 105 of the seal device through bore 104. Chamber 110 may be filled with a mobile substance as described above in connection with the first embodiment. The front end seal 84A of the receptacle socket module in this embodiment is modified to exclude the previous extended wiper portion, since this function is replaced by the pin seal device 100.

FIG. 11 illustrates the position of an electrical probe or pin 15 of a mating plug unit 12 when the plug unit 12 and receptacle unit 202 are in mating engagement and the pin 15 has entered the aligned electrical socket module 68 with the conductive tip 48 in electrical contact with the contact band or socket 16 (not visible in the drawing). As the units are moved into mating engagement, the forward end of pin 15 engages the forward end of stopper 88A and starts to push the stopper inwardly. The forward end portion 105 of the seal through bore then engages and slides over the pin as the pin is pushed further into the socket module 68. At the same time, an opposing front end portion 112 of the plug unit 12 or the base 44 in which the pin is mounted engages the front end face 106 of the pin seal device. As in the previous embodiment, continued movement of the pin from this point pushes the front end of the seal device 100 rearward, causing the wall portion 114 of the pin seal device to deform outwardly and bias the front end of the seal device into sealing engagement with the opposing front end portion 112 of the plug unit, as illustrated in FIG. 11.

In a connector having multiple pins and sockets, a seal device 100 as illustrated in FIGS. 10 and 11 may be associated with each electrical socket module 68, for sealing engagement with the respective pins as they are moved into mating engagement with the aligned socket modules.

Figure 12:
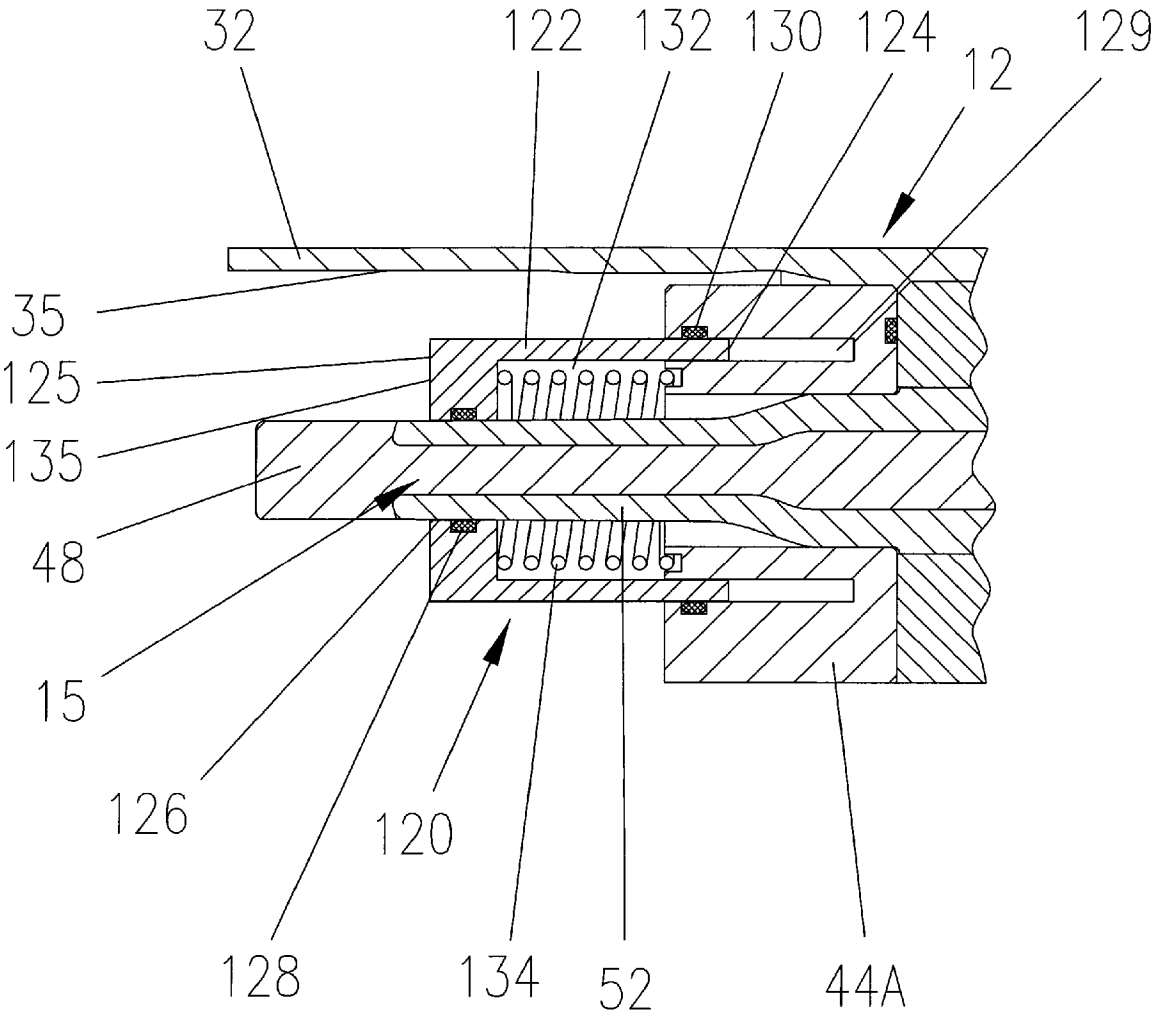
FIG. 12 is an enlarged cross-sectional view of part of the front end portion of a modified plug unit or first connector unit with a pin seal device according to another embodiment installed on the pin.
Figure 13:
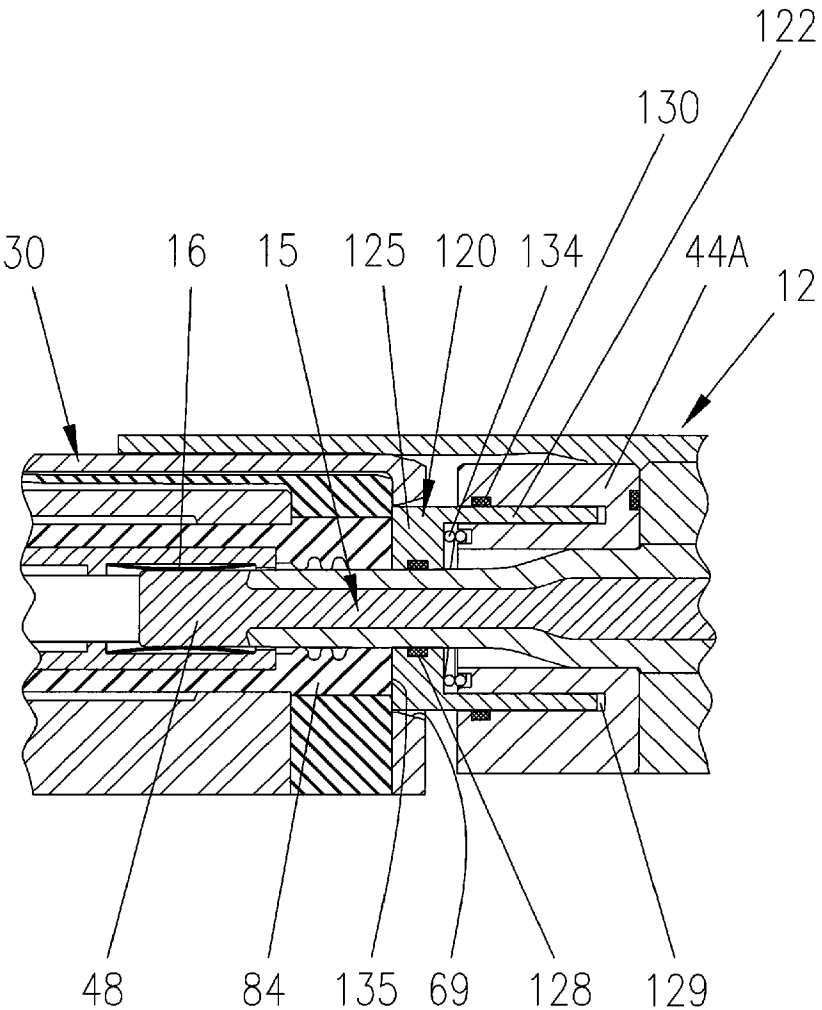
FIG. 13 is an enlarged cross-sectional view of part of the mating ends of the first connector unit of FIG. 12 and a second connector unit, illustrating the fully mated condition.

FIGS. 12 and 13 illustrate a modified seal device 120 engaged over a pin 15 of a plug unit or first connector unit 12 in place of the pin seal device 10 of the first embodiment. The connector unit 12 is similar to the connector unit of FIGS. 1 to 8, except for modification of the retaining base 44A for mounting the modified seal device 120, as described in more detail below. In the previous embodiments, the seal devices were made in one piece from a suitable elastomeric material. In this embodiment, the seal device has multiple parts, only some of which are elastomeric, and comprises a generally cylindrical housing 122 of plastic or other rigid material having an open rear end 124 and a front end wall 125 with a central opening 126 through which a forward end portion of the pin 15 extends, and first and second O-ring seals 130, 128, as described in more detail below. Elastomeric O-ring seal 128 is mounted in an annular groove or seat in opening 126 to form a sliding seal with the outer surface of pin 15. The rear end 124 of the seal device 120 is slidably engaged in an annular cavity or indent 129 which extends inwardly from a front end face of the modified base or retainer member 44A. O-ring seal 130 is mounted in an annular groove or seat in the outer cylindrical wall of cavity 129 and forms a sliding seal with the outer face of the rear end portion of the seal device which is engaged in cavity 129. This arrangement defines a chamber 132 inside the seal device which surrounds pin 15, and the chamber 132 may contain a mobile substance or a fluid, such as oil, grease, or the like. A suitable vent passage through the retainer member 44A (not illustrated) connects chamber 132 to a pressure compensated bladder chamber to allow the housing to move inwardly as the connector units are moved into the mated condition illustrated in FIG. 13.

A compression spring 134 is mounted in the chamber 132 to extend between the front face of base member 44A and the inner face of end wall 125, which biases the seal device into the extended position of FIG. 12 when the plug unit is in an unmated condition. If the plug unit contains multiple pins 15, a similar seal device may be engaged over a forward end portion of each of the pins, or the housing 122 may be enlarged to extend over all of the pins with openings 126 receiving the ends of the respective pins.

FIG. 13 illustrates the plug unit 12 with the modified seal device 120 in mating engagement with a receptacle unit 30. When the plug and receptacle units are mated, the front end face 135 of seal device 120 engages the opposing front end wall of the end seal 84, similar to the end face of pin seal device 10 as seen in FIGS. 8A and 8B. However, in this embodiment, instead of the wall of the device deforming as the plug unit is moved forward and the pin moves further inward, the housing is pushed back further into annular cavity 129 and the spring 134 is compressed. Spring 134 biases the front end face 135 into sealing engagement with the opposing end face of the end seal 84.

Figure 14:
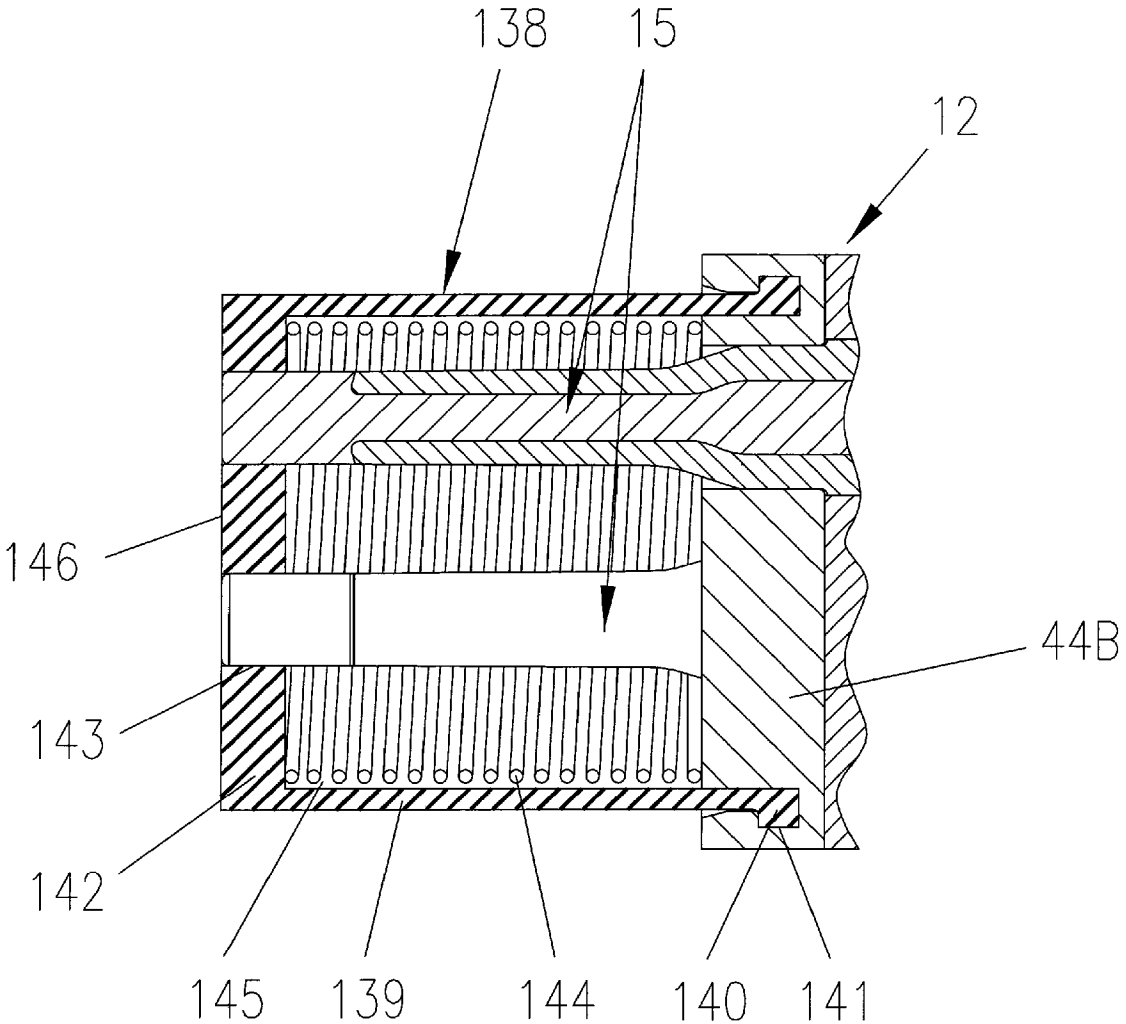
FIG. 14 is an enlarged cross-sectional view of the front end portion of a first connector unit or plug unit having a modified pin seal device engaged over two pins.
Figure 15:
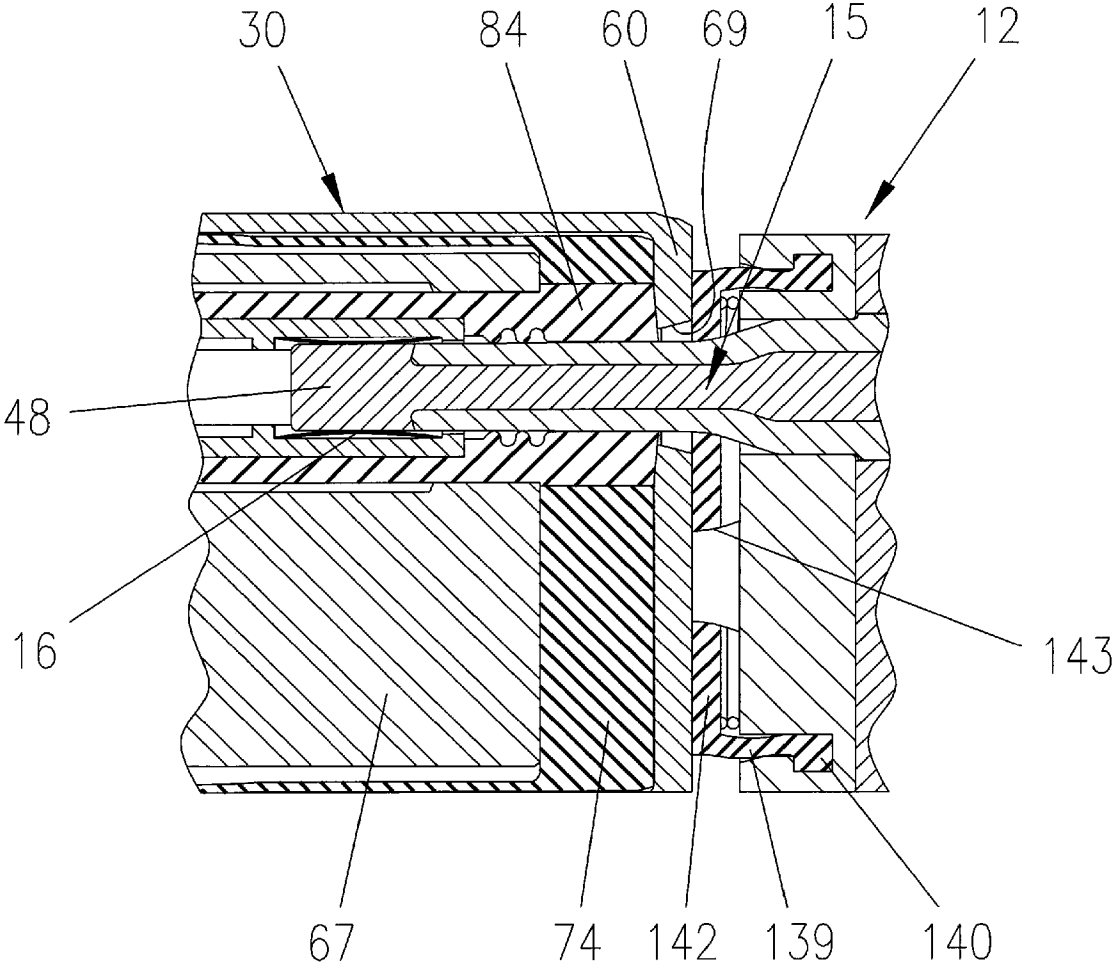
FIG. 15 is an enlarged cross-sectional view of the front end portion of the plug unit of FIG. 14 engaged with a mating receptacle unit.

FIGS. 14 and 15 illustrate another modified pin seal device 138 which is designed to provide a seal to multiple pins 15, rather than a single pin as in the previous embodiments. Seal device 138 comprises a cylindrical bladder 139 of elastomeric material such as rubber or the like which has a rear end or annular flange 140 in sealing engagement in an annular seat 141 provided in the retaining member 44B of plug unit 12. The cylindrical bladder extends forward from retaining member 44B over the projecting end portions of the pins 15, and has a forward end wall 142 with openings 143 aligned with the respective pins 15. In the unmated condition of FIG. 13, the tip 48 of each pin extends into the respective aligned opening 143. In one embodiment, each tip 48 is in sealing engagement with the respective opening 143. A biasing spring 144 inside the chamber 145 in the cylindrical bladder urges the seal device 138 into the extended position of FIG. 14. The chamber 145 may be filled with a mobile substance such as a fluid, grease, or the like, and the mobile substance may be a dielectric. Although only two pins 15 are visible in FIG. 14, the pin seal device 138 may be designed to surround any number of pins.

FIG. 15 illustrates the seal device 138 when the plug unit on which it is mounted is in mating engagement with an opposing receptacle unit 30. The front end face of the receptacle shell engages the front end face 146 of the forward end wall 142, pushing the end wall 142 rearward and compressing spring 144 while the tips of the pins 15 enter the aligned receptacle socket modules. The deformed wall portion 139 of the seal device 138 and the compressed spring 144 urge the front end face 146 of the seal into sealing engagement with the opposing front end face of the receptacle shell 60 in the mated condition of FIG. 15.

Figure 16:
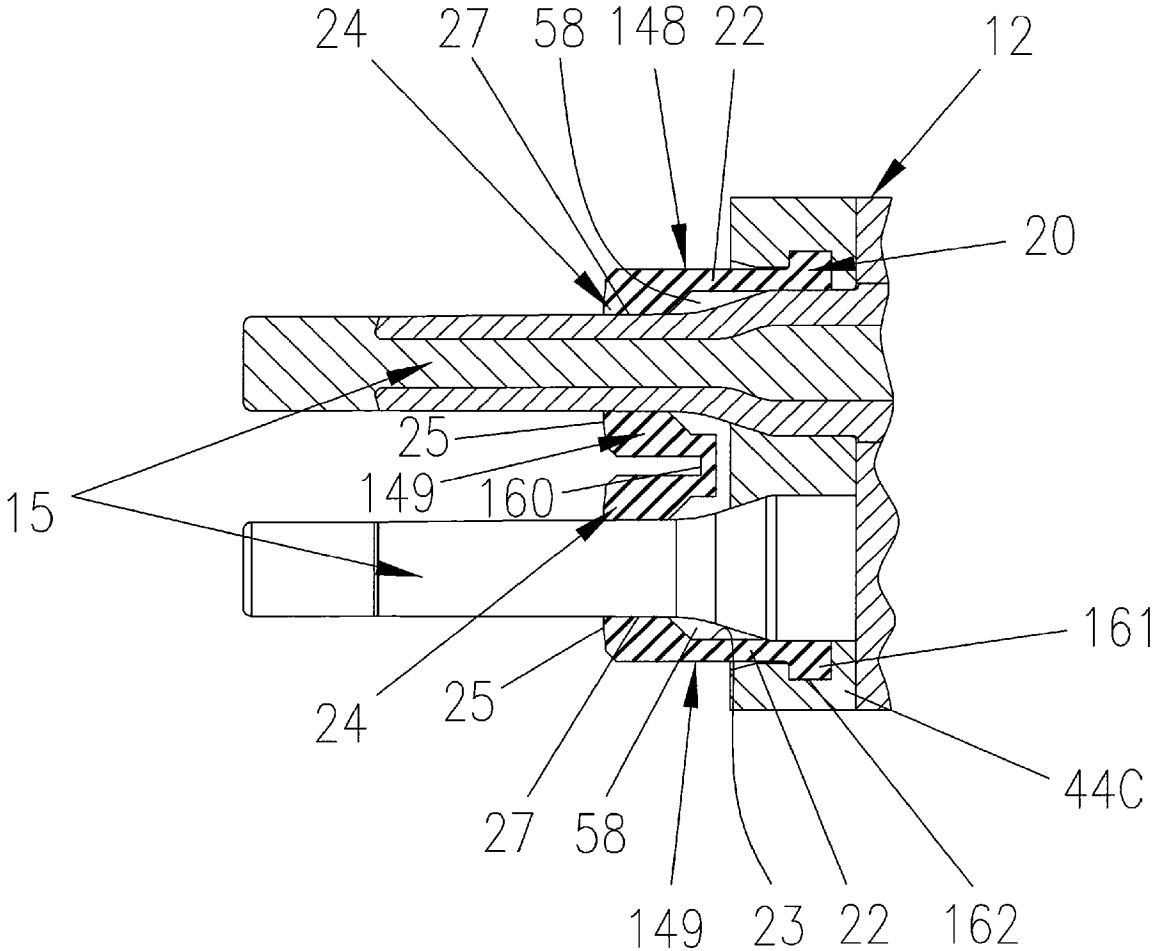
FIG. 16 is an enlarged cross-sectional view of the front end portion of a first connector unit or plug unit having a modified pin seal device which is engaged over multiple pins.
Figure 17:
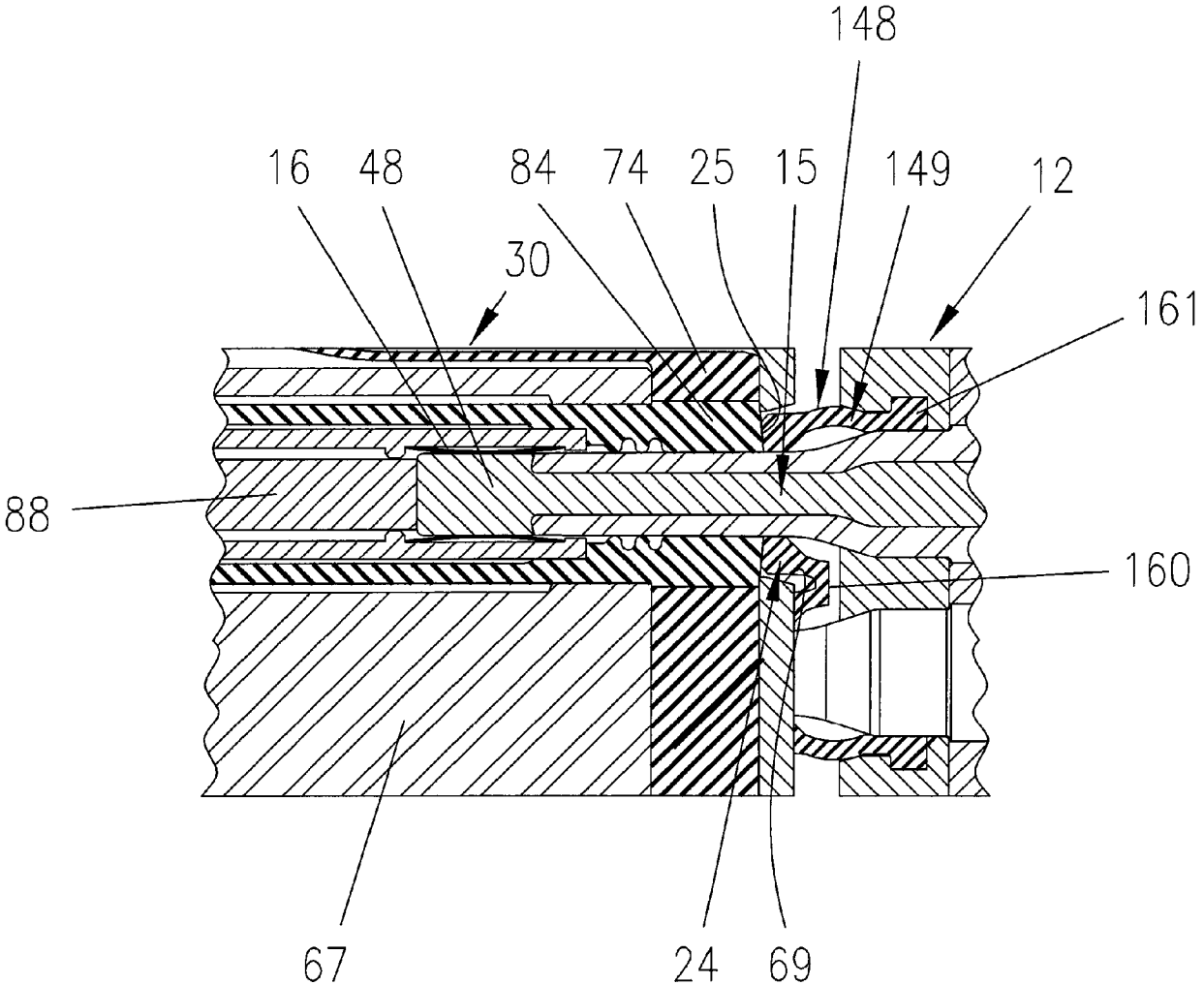
FIG. 17 is an enlarged cross-sectional view of the front end portion of the plug unit of FIG. 16 engaged with a mating receptacle unit.

FIGS. 16 and 17 illustrate another embodiment of a pin seal device 148 which can provide a seal about multiple pins simultaneously. This device is very similar to the individual pin seal 10 of FIGS. 1 to 8, and like reference numbers are used as appropriate. As is the case with the embodiment of FIGS. 1 to 8, pin seal device 148 is made entirely of a suitable elastomeric material. However, in this case, a plurality of pin seal members 149 engaging over respective pins 15 are connected by connecting web portions 160, with a single annular flange 161 at the rear end of the device 148 surrounding all of the pin seal devices and engaging in an annular seat 162 in retaining member 44C. Chambers 58 in each pin seal member 149 may be filled with a suitable mobile substance such as an oil, grease, or the like, which may be a dielectric. Operation of the pin seal device 148 is identical to the operation of the individual pin seal devices 10 when engaged over multiple pins, apart from the fact that adjacent pin seal members are connected together in a unitary structure, and reference is made to the description of FIGS. 8A and 8B in this regard.

Dielectric insulators of electrical pins or probes in prior art underwater or harsh environment high voltage connectors may become damaged over time due to material degradation as a result of electrical stress and exposure to harsh environmental conditions. The secondary sealing or pin seal device described above increases electrical safety margins and limits exposure of the primary insulator or dielectric insulator to sea water in an undersea pin and socket electrical or hybrid connector. The pin seal device provides at least one additional barrier between the conductor and the ground plane, and provides two additional barriers when the internal chamber is filled with a dielectric mobile substance. It also increases the tracking distance from the conductor to the ground plane. The pin seal device provides multiple seals in a single unit, and limits exposure of the primary insulator to the surrounding environment throughout deployment. The pin seal device provides a low pressure seal to a front face of one of the connector units in the mated condition, and provides at least one layer of insulator secondary to the primary insulator or dielectric outer layer of the pin, which lowers the electrical field stress on the primary insulator and potentially increases its lifetime. In each embodiment, the pin seal device extends over part of the pin which would otherwise be exposed in the mated condition of the connector units, and forms a sealed chamber around that part of the pin.

Although the embodiments described above are harsh environment or submersible electrical connector with one or more pin seal devices extending over part of each pin of the connector at least in the mated condition of the connector units, the pin seal devices may be installed on the electrical pins of an underwater hybrid connector in alternative embodiments. For example, each pin of a wet mateable electro-optical connector as described in U.S. Pat. No. 6,332,787 of Barlow et al., referenced above, may have a pin seal device as described herein installed on its forward end in exactly the same way as described above, with the plug and connector unit end walls suitably modified to accommodate the pin seal device.

The above description of the disclosed embodiments is provided to enable any person skilled in the art to make or use the invention. Various modifications to these embodiments will be readily apparent to those skilled in the art, and the generic principles described herein can be applied to other embodiments without departing from the spirit or scope of the invention. Thus, it is to be understood that the description and drawings presented herein represent a presently preferred embodiment of the invention and are therefore representative of the subject matter which is broadly contemplated by the present invention. It is further understood that the scope of the present invention fully encompasses other embodiments that may become obvious to those skilled in the art and that the scope of the present invention is accordingly limited by nothing other than the appended claims.

The invention claimed is:

1. A connector apparatus, comprising:

a first connector unit having at least one electrical pin, the pin having a forward end portion which projects in a forward direction;

a second connector unit having at least one electrical socket module which receives the electrical pin when the connector units are in a mated condition;

at least one pin seal device located in one of the connector units which is at least partially comprised of an elastomeric material, the pin seal device having a forward end, a rear end, and a through bore which engages over part of the forward end portion of the pin at least in a mated condition of the connector units, the bore having an inner diameter along part of its length which is greater than the outer diameter of the forward end portion of the pin to define a chamber between the outer surface of the pin and an opposing portion of the pin through bore at least in the mated condition of the connector units; and the pin seal device having at least a first seal in sealing engagement with a portion of said one connector unit and a second seal spaced from the first seal, the second seal being in sealing engagement with a portion of the other connector unit when the units are in a mated condition.

2. The apparatus of claim 1, wherein the pin seal device is located in the second connector unit and engages over the pin only in the mated condition of the connector units.

3. The apparatus of claim 1, wherein the pin seal device is a one piece member comprised of elastomeric material.

4. The apparatus of claim 1, wherein the first and second seals are end seals located at opposite ends of the pin seal device and the chamber extends between the end seals.

5. The apparatus of claim 1, wherein the first connector unit has a plurality of electrical pins and the second connector unit has a corresponding number of electrical socket modules each positioned for receiving a forward end of a respective pin in the mated condition of the units, and a corresponding number of pin seal devices are located in one of the connector units, the through bore of each pin seal device engaging over part of the forward end portion of a respective pin at least in the mated condition of the connector units.

6. The apparatus of claim 1, wherein the first connector unit has a plurality of electrical pins and the second connector unit has a corresponding number of electrical socket modules each positioned for receiving a forward end of a respective pin in the mated condition of the units, and the pin seal device has a corresponding number of through bores each engaging over a forward portion of a respective pin at least when the units are mated.

7. The apparatus of claim 1, wherein the chamber extends between the first and second seals.

8. The apparatus of claim 1, wherein the pin seal device is located in the first connector unit and engaged over at least part of the forward end portion of the pin in an unmated condition of the first connector unit.

9. The apparatus of claim 8, wherein the first seal comprises a rear end seal retained in part of the first connector unit and the pin seal device extends forward from the rear end seal over part of the length of the pin.

10. The apparatus of claim 1, wherein the electrical pin comprises a elongate conductive member having a forward end and an outer casing layer of insulating material surrounding the conductive member along at least part of its length, the outer casing layer terminating short of the forward end of the conductive member to form an exposed conductive tip of the pin, the pin seal device engaging over part of the outer casing layer at least in the mated condition of the connector units.

11. The apparatus of claim 10, wherein the electrical socket module has a contact socket which receives the exposed conductive tip of the pin when the connector units are mated.

12. The apparatus of claim 1, wherein at least one of the seals is in sealing engagement with an opposing portion of the pin at least in the mated condition of the connector units.

13. The apparatus of claim 12, wherein the pin seal device is located in the first connector unit.

14. The apparatus of claim 13, wherein the first and second seals are in engagement with spaced portions of the pin.

15. The apparatus of claim 14, wherein the first and second seals are in sealing engagement with spaced portions of the pin.

16. The apparatus of claim 1, wherein said second seal engages an opposing portion of the pin at least in the mated condition of the connector units.

17. The apparatus of claim 16, wherein the second seal is in sealing engagement with an opposing portion of the pin and an opposing portion of one of the connector units at least in the mated condition of the connector units.

18. The apparatus of claim 1, wherein said one connector unit has a seat which receives the first seal, and the first seal comprises a gland seal having an inner diameter in an unstressed condition which is less than the outer diameter of the pin over which it engages, and an outer diameter in an unstressed condition which is greater than the inner diameter of the seat.

19. The apparatus of claim 18, wherein the first seal comprises an annular rim at one end of the pin seal device.

20. The apparatus of claim 1, wherein the pin seal device has a forward end wall having at least one opening through which the pin projects at least in the mated condition of the connector units.

21. The apparatus of claim 20, wherein the pin seal device comprises a rigid housing having an O-ring seal in the opening in said forward end wall, the O-ring seal being in sealing engagement with an opposing portion of the pin at least in the mated condition of the connector units.

22. The apparatus of claim 20, wherein the pin seal device is formed of elastomeric material and the inner surface of the opening is in sealing engagement with an opposing portion of the pin at least in the mated condition of the connector units.

23. The apparatus of claim 22, wherein the pin seal device is located in the first connector unit and the inner surface of the opening seals against an opposing portion of the pin in both an unmated condition and the mated condition of the connector units.

24. The apparatus of claim 22, wherein the socket module has a slidably mounted stopper which is biased into an extended position in an unmated condition of the second connector unit, a forward end portion of the stopper projecting forward out of the socket module in an unmated condition of the units, and the pin seal device is located in the second connector unit and projects over at least part of the forward end portion of the stopper in the unmated condition of the second connector unit, the inner surface of the opening sealing against an opposing portion of the stopper in the unmated condition and sealing against an opposing portion of the pin in the mated condition of the units.

25. The apparatus of claim 1, wherein the chamber is filled with a mobile substance.

26. The apparatus of claim 25, wherein the mobile substance is a dielectric.

27. The apparatus of claim 25, wherein the mobile substance is a fluid.

28. The apparatus of claim 25, wherein the chamber is filled with dielectric oil.

29. The apparatus of claim 1, wherein the chamber has an annular end wall between the chamber and second seal.

30. The apparatus of claim 29, wherein the annular end wall is tapered towards the forward end of the seal device.

31. The apparatus of claim 1, wherein the pin seal device further comprises a biasing mechanism which urges the second seal into sealing engagement with an opposing surface of said other connector unit in the mated condition of the connector units.

32. The apparatus of claim 31, wherein the biasing mechanism comprises a deformable wall portion between the first and second seals which is deformed as the connector units are mated, whereby the deformed wall portion provides a biasing force urging the second seal into sealing engagement with an opposing surface of said other connector unit.

33. The apparatus of claim 31, wherein the biasing mechanism comprises a spring.

34. The apparatus of claim 1, wherein the first and second seals are located at opposite ends of the pin seal device and a connecting wall portion extends between the first and second seals, the connecting wall portion comprising an outer wall of said chamber.

35. The apparatus of claim 34, wherein the connecting wall portion is deformable and the length of the seal device in the unmated condition of the connector units is greater than the length of the seal device in the mated condition.

36. The apparatus of claim 8, wherein the second connector unit has a forward end wall having an opening aligned with the electrical socket module, and the socket module has a forward end with an opening which receives a forward end of the pin, the forward end of the pin seal device extending into the opening in the forward end wall to engage an opposing end face of the socket module as the units are mated.

37. The apparatus of claim 36, wherein the opening in the forward end wall of the second connector unit is tapered outwardly.

38. The apparatus of claim 36, wherein the opening in the forward end wall of the second connector unit has a diameter larger than the outer diameter of the forward end of the pin seal device, and a clearance is provided between the forward end of the pin seal device and the opening in the forward end wall of the second connector unit when the units are fully mated.

39. The apparatus of claim 8, wherein the second seal comprises an end seal which has a forward end face in sealing engagement with an opposing portion of the second connector unit in the mated condition of the connector units.

40. The apparatus of claim 39, wherein the forward end of the pin seal device and opposing portion of the second connector unit have aligned openings and annular, frusto-conical faces surrounding the openings, the end faces first coming into contact at opposing central regions adjacent the aligned openings as the connector units are moved into mating engagement.

41. A pin seal device for providing a secondary seal to a pin of a submersible connector, comprising:

a tubular seal member having a through bore, a first end and a second end;

a first end seal comprising an annular rim at the first end of the seal member which engages in an annular seat in a first connector unit;

the through bore having a reduced diameter end portion extending up to the second end of the seal member which engages an opposing surface portion of a pin in the first connector unit on a part of the pin which projects out of the first connector unit;

a connecting wall portion between the first end seal and the second end of the seal member which has an inner diameter greater than the diameter of the reduced diameter end portion, the connecting wall portion forming a chamber between an inner surface of the wall portion and an opposing outer surface portion of a pin when the device is installed over the pin; and the second end of the seal member having an end face and the connecting wall portion being resiliently deformable and biasing the end face into sealing engagement with an opposing face of a second connector unit when the seal member is engaged over a pin of the first connector unit which is in mating engagement with the second connector unit.

42. The seal device of claim 41, wherein the second end of the seal member has an end face which is of frusto-conical shape.

43. The seal device of claim 42, further comprising a chamfered rim surrounding the end face.

44. A connector apparatus, comprising:

a first connector unit having a rear end, a forward end, and at least one electrical pin, the pin having a forward end portion which projects in a forward direction;

a second connector unit having at least one electrical socket module which receives the electrical pin when the connector units are in a fully mated condition;

the connector units having opposing end faces which face towards one another in the fully mated condition of the units; and at least one pin seal device which is at least partially comprised of an elastomeric material, the pin seal device having a rear end seated in one of the connector units and projecting forward from the end face of said one connector unit, a forward end wall which is in sealing engagement with an opposing portion of the other connector unit in the mated condition of the units, and a chamber between the rear end and forward end wall, the forward end wall having at least one opening;

the rear end of the pin seal device comprising a first end seal and the forward end wall comprising a second end seal, and the forward end portion of the pin extending through the chamber and the opening in the forward end wall of the pin seal device at least in the fully mated condition of the units;

whereby the chamber surrounds at least part of the pin which extends between the connector units in the fully mated condition of the units.

* * * * *